US005708917A

United States Patent [19]

Kawai et al.

[11] Patent Number: 5,708,917

[45] Date of Patent: Jan. 13, 1998

[54] TONER REPLENISHMENT DEVICE FOR AN IMAGE FORMING APPARATUS WHICH EMPLOYS PIXEL DENSITY AND TONER DENSITY INFORMATION

[75] Inventors: Atsushi Kawai, Aichi-ken; Masaki Tanaka, Toyohashi; Tetsuya Sakai; Yukihiko Okuno, both of Toyokawa, all of Japan

[73] Assignee: Minolta Co., Ltd., Osaka, Japan

[21] Appl. No.: 611,215

[22] Filed: Mar. 5, 1996

[30] Foreign Application Priority Data

Mar. 6, 1995 [JP] Japan ..... 7-045995

[51] Int. Cl.[6] ..... G03G 15/08

[52] U.S. Cl. ..... 399/58; 399/42; 399/44; 399/60

[58] Field of Search ..... 355/204, 208, 355/246; 399/58, 59, 60, 44, 42; 358/276, 300

[56] References Cited

U.S. PATENT DOCUMENTS

| | | | |
|---|---|---|---|
| 5,146,274 | 9/1992 | Hattori et al. . | |
| 5,202,769 | 4/1993 | Suzuki | 358/300 |
| 5,204,718 | 4/1993 | Morita | 355/246 |

FOREIGN PATENT DOCUMENTS

| | | | |
|---|---|---|---|
| 63-40179 | 2/1988 | Japan . | |
| 63-292172 | 11/1988 | Japan . | |
| 2-19873 | 1/1990 | Japan . | |
| 4-317091 | 11/1992 | Japan | 355/246 |
| 5-27597 | 2/1993 | Japan . | |
| 5-27598 | 2/1993 | Japan . | |
| 5-150655 | 6/1993 | Japan | 355/246 |
| 6-230670 | 8/1994 | Japan | 355/246 |

*Primary Examiner*—Joan H. Pendegrass
*Attorney, Agent, or Firm*—Burns, Doane, Swecker & Mathis, LLP

[57] ABSTRACT

The image forming apparatus is provided with a detecting means for detecting transfer efficiency when transferring a toner image from a photosensitive member to a transfer sheet, and a developing efficiency changing means for changing developing efficiency based on the transfer efficiency detected by the detecting means, and corrects the toner consumption predicted by the predicting means based on the transfer efficiency as detected by the detecting means, so as to determine the amount of toner to be replenished. When the developing efficiency is changed based on the transfer efficiency, toner consumption also changes, and does not match the predicted toner consumption. According to the present invention, toner concentration in a developer can be even more accurately controlled by correcting the predicted toner consumption by the change in transfer efficiency. Detection of transfer efficiency is achieved by a method of indirectly detecting humidity in the apparatus, or a method of measuring the amount of toner transferred to a transfer member.

11 Claims, 28 Drawing Sheets

FIG. 26

| Density Table No. | Amount of Adhered Toner ($mg/cm^2$) | Grid Voltage Vg (V) | Charge Potential Vo (V) | Developing Bias Voltage Vb (V) |
|---|---|---|---|---|
| 0 | 0.625 | 500 | 480 | 280 |
| 1 | 0.510 | 540 | 520 | 320 |
| 2 | 0.445 | 570 | 545 | 345 |
| 3 | 0.400 | 600 | 570 | 370 |
| 4 | 0.380 | 630 | 590 | 390 |
| 5 | 0.340 | 670 | 630 | 420 |
| 6 | 0.305 | 710 | 660 | 440 |
| 7 | 0.275 | 750 | 700 | 480 |
| 8 | 0.250 | 800 | 750 | 540 |
| 9 | 0.210 | 900 | 820 | 620 |
| 10 | 0.180 | 1000 | 910 | 710 |

FIG.27

| Density Level of Image Data | Amount of Adhered Toner (mg/dot) |
|---|---|
| 0 | 0 |
| 1 | 0.0010 |
| 2 | 0.0015 |
| 3 | 0.0020 |
| 4 | 0.0025 |
| . | . |
| . | . |
| . | . |
| . | . |
| . | . |
| 254 | 0.069 |
| 255 | 0.07 |

FIG. 28

Predicted Consumption

| Estimated Toner Concentration | | NL | NS | ZO | PS | PL |
|---|---|---|---|---|---|---|
| | NL | ZO | PS | PS | PL | PL |
| | NS | NS | ZO | PS | PS | PL |
| | ZO | NL | NS | ZO | PS | PL |
| | PS | NL | NL | NS | ZO | NS |
| | PL | NL | NL | NL | NS | NS |

FIG. 29

| Rule | | Predicted Consumption | | Estimated Toner Concentration | | Toner Replenishment Amount |
|---|---|---|---|---|---|---|
| 1 | if | NS | and | ZO | then | NS |
| 2 | if | ZO | and | ZO | then | ZO |
| 3 | if | NS | and | PS | then | NL |
| 4 | if | ZO | and | PS | then | NS |

FIG.30

| Absolute Humidity ($g/m^3$) | Correction Coefficient |
|---|---|
| 0 | 1.05 |
| 0.5 | 1.04 |
| 0.2 | 1.03 |
| . | . |
| . | . |
| . | . |
| . | . |
| . | . |
| 6.0 | 1.30 |
| . | . |
| . | . |
| . | . |
| . | . |
| . | . |
| 15.0 | 1.80 |

FIG.31

| Predicted Transfer Efficiency (%) | Correction Coefficient |
|---|---|
| 60 | 1.80 |
| 61 | 1.79 |
| 62 | 1.78 |
| . | . |
| . | . |
| . | . |
| . | . |
| . | . |
| 80 | 1.30 |
| . | . |
| . | . |
| . | . |
| . | . |
| . | . |
| 99 | 1.05 |

FIG.32

| Transfer Efficiency (T) (%) | Correction Coefficient (1/T) |
|---|---|
| 60 | 1/0.60 |
| 61 | 1/0.61 |
| 62 | 1/0.62 |
| . | . |
| . | . |
| . | . |
| . | . |
| . | . |
| 80 | 1/0.80 |
| . | . |
| . | . |
| . | . |
| . | . |
| . | . |
| 99 | 1/0.99 |

TONER REPLENISHMENT DEVICE FOR AN IMAGE FORMING APPARATUS WHICH EMPLOYS PIXEL DENSITY AND TONER DENSITY INFORMATION

BACKGROUND OF THE INVENTION

1. Field of the Invention

The present invention relates to an image forming apparatus for forming an electrostatic latent image on a photosensitive member and developing the latent image with toner by means of a developing device, in accordance with image signals expressing a density level for each pixel of the image.

2. Description of the Related Art

In an image forming apparatus of the electrophotographic type, two-component developers comprising a mixture of a carrier and a toner typically are used to develop an electrostatic latent image formed on the surface of a photosensitive member. When a two-component developer is used, the toner concentration Tc in the developer (the weight ratio of toner per total weight of developer) changes because toner alone is consumed in conjunction with image formation, such that a suitable amount of toner must be resupplied to the developer so as to maintain toner concentration Tc at a predetermined standard value.

Conventional toner replenishment control methods include well-known methods such as the ATDC method wherein the magnetic permeability of the developer is sensed via a magnetic sensor, or the amount of light reflected by the developer is detected by an optical sensor, so as to estimate the toner concentration Tc in the developer and resupply the required amount of toner. Also known are AIDC methods wherein the amount of light reflected by a toner test image formed on the surface of a photosensitive member under constant image forming conditions is detected by an optical sensor to calculate the developing efficiency. Toner concentration Tc in the developer is estimated from the developing efficiency so as to resupply the required amount of toner.

While the ATDC method can be used in apparatuses which form full color images using toners of four colors, i.e., cyan, magenta, yellow, and black, disadvantages arise relating to black toner. That is, silica and the like are added to black toner to improve developing flow characteristics and improve image quality, but the bulk density of the toner fluctuates due to changes in humidity, thereby causing serious errors in toner concentration detection performed by magnetic sensors. Furthermore, black toner is commonly mixed with carbon black to enhance the deepness of its black color, but this mixing gives rise to other disadvantages when optical sensors are used, because the spectral reflectivity characteristics approach that of the carrier.

In recent years, methods have been developed for replenishing toner by predicting toner consumption by adding density information for each pixel determined by a dot counter based on density information included in digital image signals, and offsetting the predicted toner consumption by resupplied toner. Such a method is disclosed, for example in Japanese Unexamined Patent Application No. HEI 4-238374.

Even in the toner replenishment control method that is carried out by dot counter, there invariably are difficulties in maintaining toner concentration in the developer at a standard concentration. The reasons for these difficulties are errors in predicting toner consumption, errors in the toner replenishment itself, toner leakage from the developing device, and differences in predicted consumption and toner actually consumed when the developing efficiency is controlled based on changes in transfer efficiency.

SUMMARY OF THE INVENTION

An object of the present invention is to provide an image forming apparatus capable of improving the accuracy of toner consumption prediction that is carried out by dot counter.

In the present invention, the amount of toner consumed by image formation is basically predicted beforehand from the density level of each pixel of the image signals, and the amount of toner to be resupplied is determined in accordance with the predicted toner consumption. The amount of toner to be replenished is corrected, based on the developer toner concentration in the developing device as estimated from a toner test image. For example, when the estimated toner concentration matches a standard toner concentration the toner consumption predicted by the predicting means is identical to the amount of toner replenished. When the estimated toner concentration is less than a standard toner concentration, however, more toner is replenished than the predicted amount of toner consumption. When the estimated toner concentration is greater than a standard toner concentration, on the other hand, less toner is resupplied than the predicted amount of toner consumed. Thus, toner concentration in a developer can be accurately maintained at a predetermined standard value by controlling toner replenishment via feedback of the estimated toner concentration relative to the predicted toner consumption.

Control of toner replenishment is even more accurate when fluctuations in developing efficiency are included in the estimation of toner concentration. Fuzzy inference may be used when correcting predicted toner consumption by an estimated toner concentration. Use of fuzzy inference allows designers to apply the knowledge and knowhow that have been obtained up to now in toner replenishment control to achieve more precise toner replenishment.

The image forming apparatus of the present invention is provided with a detecting means for detecting environmental conditions (temperature and humidity) within the image forming apparatus, and determines correction coefficients from the correlation between the environmental conditions detected by the detecting means and toner loss induced by the environmental conditions, and corrects toner consumption predicted by the predicting means by the correction coefficient so as to determine the amount of toner to be replenished. Toner loss due to airborne toner dispersion during developing and toner spillage changes in accordance with environmental conditions. According to the present invention, the amount of lost toner can be added to the amount of toner replenished so as to precisely control the toner density on the photosensitive member.

The image forming apparatus of the present invention is provided with a detecting means for detecting transfer efficiency when transferring a toner image from a photosensitive member to a transfer sheet, and a developing efficiency changing means for changing developing efficiency based on the transfer efficiency detected by the detecting means, and corrects the toner consumption predicted by the predicting means based on the transfer efficiency as detected by the detecting means, so as to determine the amount of toner to be replenished. When the developing efficiency is changed based on the transfer efficiency, toner consumption also changes, and does not match the predicted toner consumption. According to the present invention, toner concentration in a developer can be even more accurately controlled by correcting the predicted toner consumption by the change in transfer efficiency. Detection of transfer efficiency is achieved by a method of indirectly detecting humidity in the apparatus, or a method of measuring the amount of toner transferred to a transfer member.

BRIEF DESCRIPTION OF THE DRAWINGS

FIG. 26 is a table stored in data ROM 102 and used for image density control;

FIG. 27 is a table stored in data ROM 102 which shows the amount of adhered toner per pixel for each density level of print data;

FIG. 28 is a table showing the fuzzy control rules used to determine toner replenishment in the second embodiment;

FIG. 29 is a table showing specific control rules for fuzzy control used to determine toner replenishment in the second embodiment;

FIG. 30 is a table stored in ROM 102 which shows the relationship between the correction coefficient and absolute humidity used in the third embodiment;

FIG. 31 is a table stored in ROM 102 which shows the relationship between the correction coefficient and predicted transfer efficiency used in the fourth embodiment; and FIG. 32 is a table stored in ROM 102 which shows the relationship between the correction coefficient and the actually measured transfer efficiency used in the fifth embodiment.

DESCRIPTION OF THE PREFERRED EMBODIMENTS

The preferred embodiments of the image forming apparatus of the present invention are described hereinafter with reference to the accompanying drawings.

(1) First Embodiment (1-1) Construction of the copying apparatus

Figure 1:
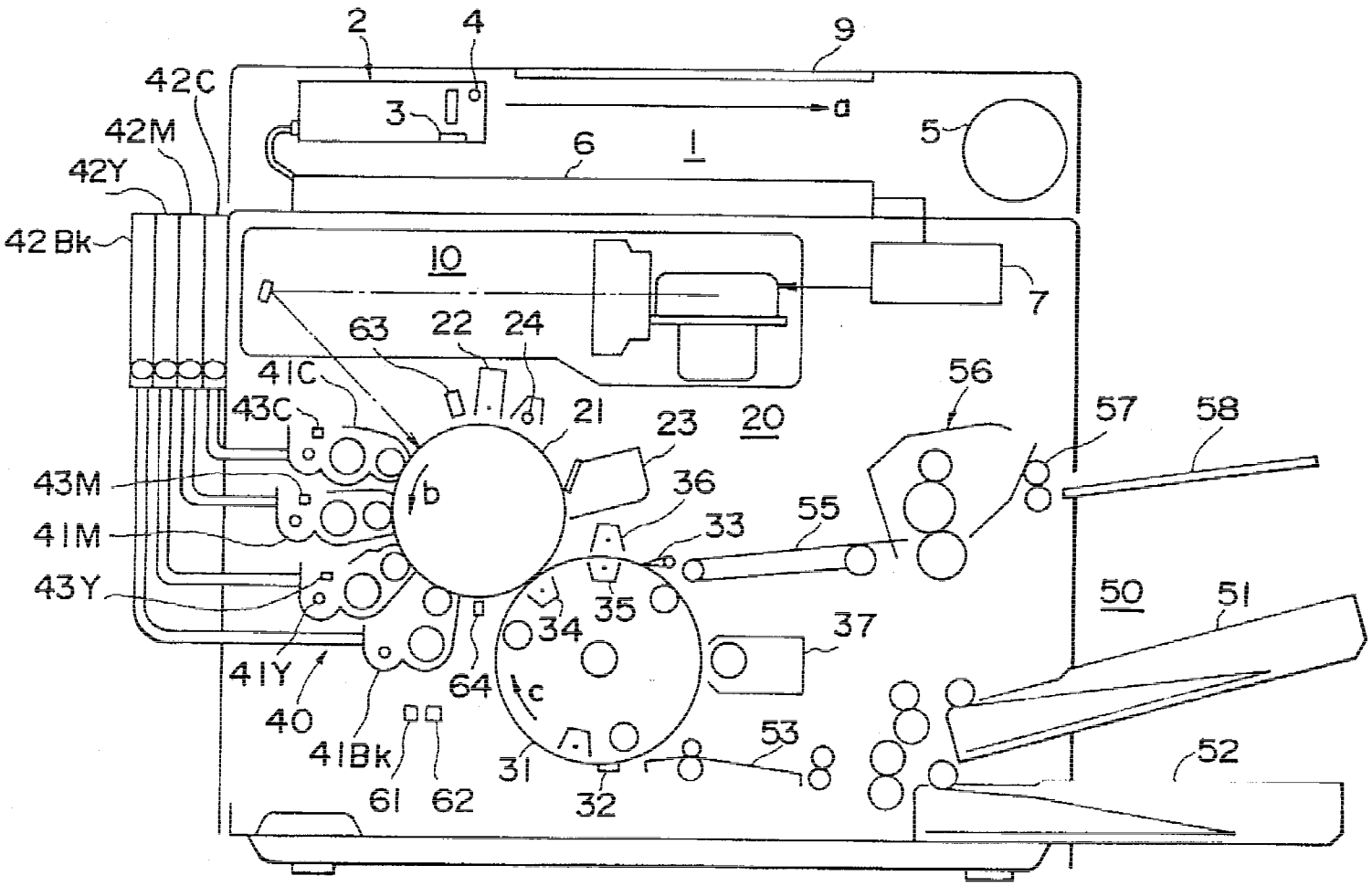
FIG. 1 shows the internal construction of a full color copier of an embodiment of the present invention.

FIG. 1 shows the general construction of a full color copier of the digital type. This copier briefly comprises an image reader unit 1, a laser scanning unit 10, full color image forming unit 20, and paper supply unit 50.

Image reader unit 1 comprises a scanner 2 for reading the image of documents placed on glass platen 9, and image signal processor 6 for converting the scanned image data to print data. Scanner 2 is a well-known type provided with a direct-type color image sensor (CCD line sensor) 3, which reads the three colors of red (R), green (G), and blue (B) as it is driven in the direction of arrow "a" by motor 5, and outputs the density level of each color as image signals. Image signal processor 6 converts the image signals from by image sensor 3 into 8-bit print data corresponding to the four colors yellow (Y), magenta (M), cyan (C), and black (BK), and edits the print data as necessary prior to transmitting this data to a synchronization buffer memory 7.

Laser scanning unit 10 is a well-known type which modulates a laser diode to form an electrostatic latent image on the surface of photosensitive drum 21 rotating in the direction of arrow "b". Laser scanning unit 10 performs halftone correction on print data input from buffer memory 7 in accordance with the halftone characteristics of the photosensitive member, and thereafter subjects the print data to digital-to-analog (D/A) conversion to generate laser diode drive signals to modulate laser diode emissions based on the drive signals.

Full color image forming unit 20 comprises a core of photosensitive drum 21 and transfer drum 31. Arranged sequentially around the periphery of photosensitive drum 21 are charger 22, developing section 40, residual toner cleaner 23, and residual charge eraser lamp 24. Developing section 40 is provided sequentially from the top to bottom with developing devices 41C, 41M, 41Y, and 41Bk which respectively accommodate developers containing cyan, magenta, yellow, and black toners. These developing devices are driven in accordance with each formation of an electrostatic latent image of each color on the surface of photosensitive drum 21. Toners are stored in hoppers 42C, 42M, 42Y, and 42Bk, and are resupplied to the suitable developing device by the toner replenishment control, described later.

Transfer drum 31 is arranged so as to be rotatably driven in the direction of arrow "c" at the same speed as photosensitive drum 21, and the toner image is transferred onto a copy sheet wrapped around the surface of the transfer drum. Transfer drum 31 is provided with a chuck member 32 for chucking the leading edge of the copy sheet on the drum, and separation member 33 for separating the copy sheet from the drum. Arranged on the interior side and exterior side of the transfer drum 31 are transfer charger 34, dischargers 35 and 36, and residual toner cleaner 37.

Paper supply unit 50 is provided with two stage paper trays 51 and 52, and feeds paper one sheet at a time from either tray 51 or 52 selected by an operator. The paper sheets fed from the trays are transported in a leftward direction through transport path 53, and wrapped around the exterior surface of transfer drum 31.

During full color image formation, cyan, magenta, yellow, and black images are sequentially formed on the surface of photosensitive drum 21, and the respective toner images are overlaid one upon another on the transfer sheet by sequential transfers via the discharge of transfer charger 34. When the four color images have been overlaid on the transfer sheet, chucking member 32 releases the transfer sheet and separation member 33 separates the transfer sheet from the transfer drum 31. The separated transfer sheet is transported to fixing device 56 by conveyor belt 55, whereupon the toner images are fixed on the transfer sheet, then ejected from discharge aperture 57 to tray 58.

Full color image forming unit 20 is provided with a humidity sensor 61 for detecting the humidity within the apparatus, a temperature sensor 62 for detecting the temperature, potential sensor 63 for detecting the surface potential of the photosensitive member, and AIDC sensor 64 for detecting the density of the toner test image. ATDC sensors 43C, 43M, and 43Y are respectively provided within color developing devices 41C, 41M, and 41Y to magnetically or optically detect the toner concentration for replenishment of color toner.

(1-2) Copying apparatus control mechanism

Figure 2:
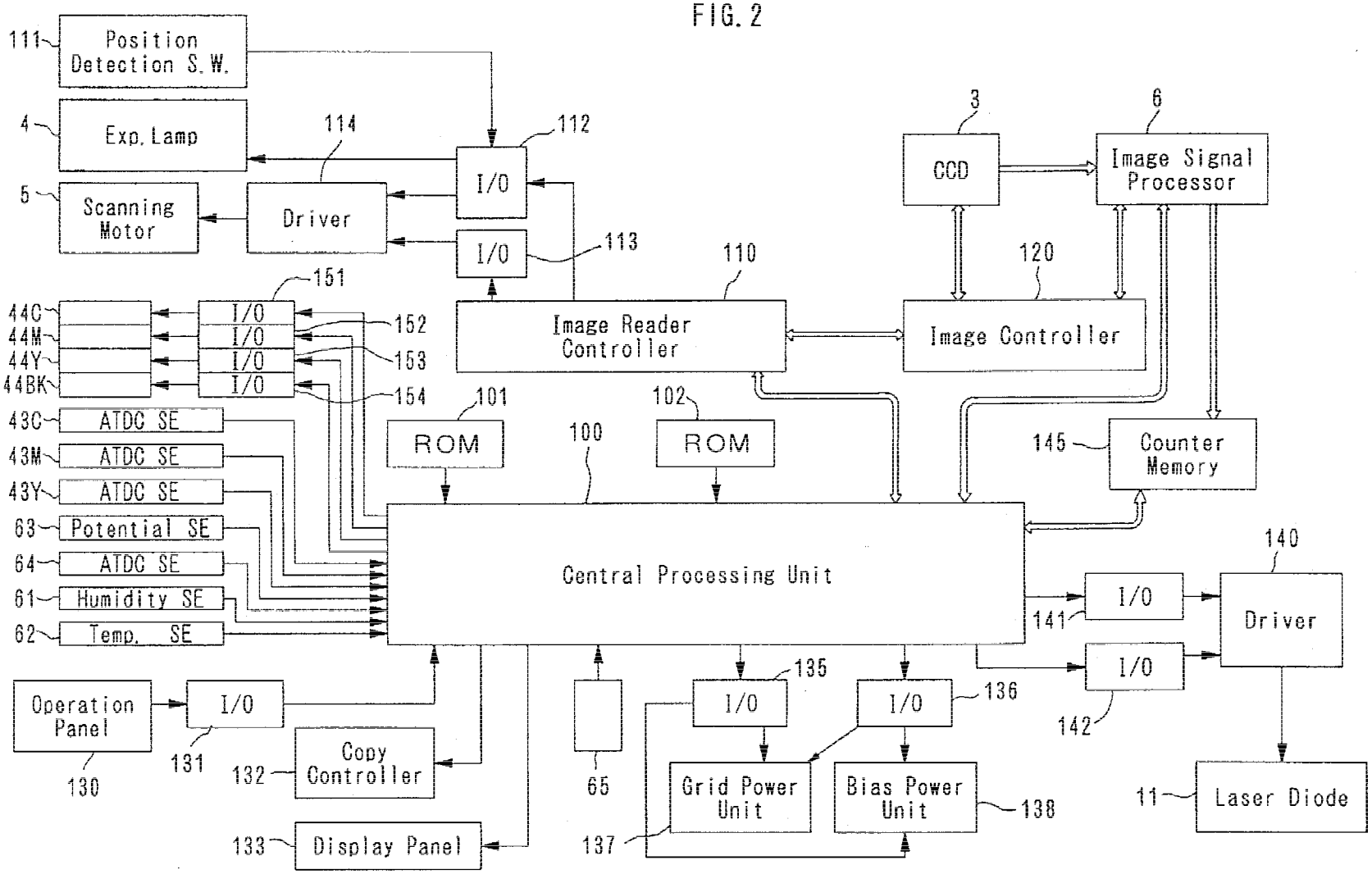
FIG. 2 is a block diagram showing the control circuit of the copier.

FIG. 2 shows the overall control circuit of the previously described copying apparatus, with the core of this control circuit comprising a central processing unit (CPU) 100. CPU 100 is provided with read only memory (ROM) 101 for storing control programs, and ROM 102 for storing various types of data.

Image reader controller 110 controls image reader unit 1. Image reader controller 110 controls the ON/OFF switching of exposure lamp 4 via drive I/O 112 by means of position signals transmitted from position detection switch 111, which indicates the position of a document placed on glass platen 9. The controller 110 further controls driver 114 of scanning motor 5 via drive I/O 112 and parallel I/O 113. Image reader controller 110 is connected to image controller 120 via a bus. Image controller 120 is mutually connected to image sensor 3 and image signal processor 6 via buses; image data scanned by image sensor 3 are input to image signal processor 6 and converted to print data.

Various analog signals are input to CPU 100 from potential sensor 63 which detects the surface potential of photosensitive drum 21, AIDC sensor 64 which optically detects the amount of adhered toner of the toner test image, ATDC sensors 43C, 43M, and 43Y which detect the toner concentrations in developing devices 41C, 41M, and 41Y, humidity sensor 61, and temperature sensor 62. Copy mode signals set by an operator on operation panel 130 are input to CPU 100 via parallel I/O 131, and copy controller 132 and display panel 133 are controlled on the basis of various types of data input from data ROM 102, i.e., in accordance with the content of control ROM 101. CPU 100 controls the developing bias power unit 138 of the developing devices and grid power unit 137 of charger 22 via parallel I/O 135 and drive I/O 136 so as to control image density set by an operator via operation panel 130 or automatic image density control set by AIDC 64.

CPU 100 is connected to image processor 6 via a bus, and after halftone correction of received print data via reference to halftone correction tables stored in data ROM 102, controls driver 140 which drives laser diode 11 via drive I/O 141 and parallel I/O 142. In the present embodiment, image halftone reproduction is accomplished by modulating the emission intensity of laser diode 11.

CPU 100 is connected to image signal processor 6 via counter memory 145. Counter memory 145 counts the number of pixels of each density level in the 8-bit per pixel print data received from image processor 6 for each single scan line of scanner 2, and stores these count values. CPU 100 reads out one scan line of print data from counter memory 145 in accordance with scanner operation signals received from image reader controller 110. Counter memory 145 deletes the one scan line of print data when these data have been read out by CPU 100. The print data read out by CPU 100 includes image density information for one scan line which is used to predict toner consumption in a manner described later.

CPU 100 receives count values from lifetime counter 65 which counts the total number of copies made.

CPU 100 drives toner resupply motors 44C, 44M, and 44Y via drive I/O 151, 152, 153, based on toner density signals from ATDC sensors 43C, 43M, and 43Y to resupply toner from hoppers 42C, 42M, and 42Y and thereby maintain a predetermined standard toner concentration within developing devices 41C, 41M, and 41Y. Toner replenishment for developing device 41Bk which accommodates black toner is accomplished with reference to toner consumption conversion correction tables stored in data ROM 102 based on data stored in counter memory 145 as black image data density information, so as to drive toner resupply motor 44Bk via drive I/O 154 to resupply black toner from hopper 42Bk. This toner replenishment control is described later.

(1-3) Image density control

Figure 3:
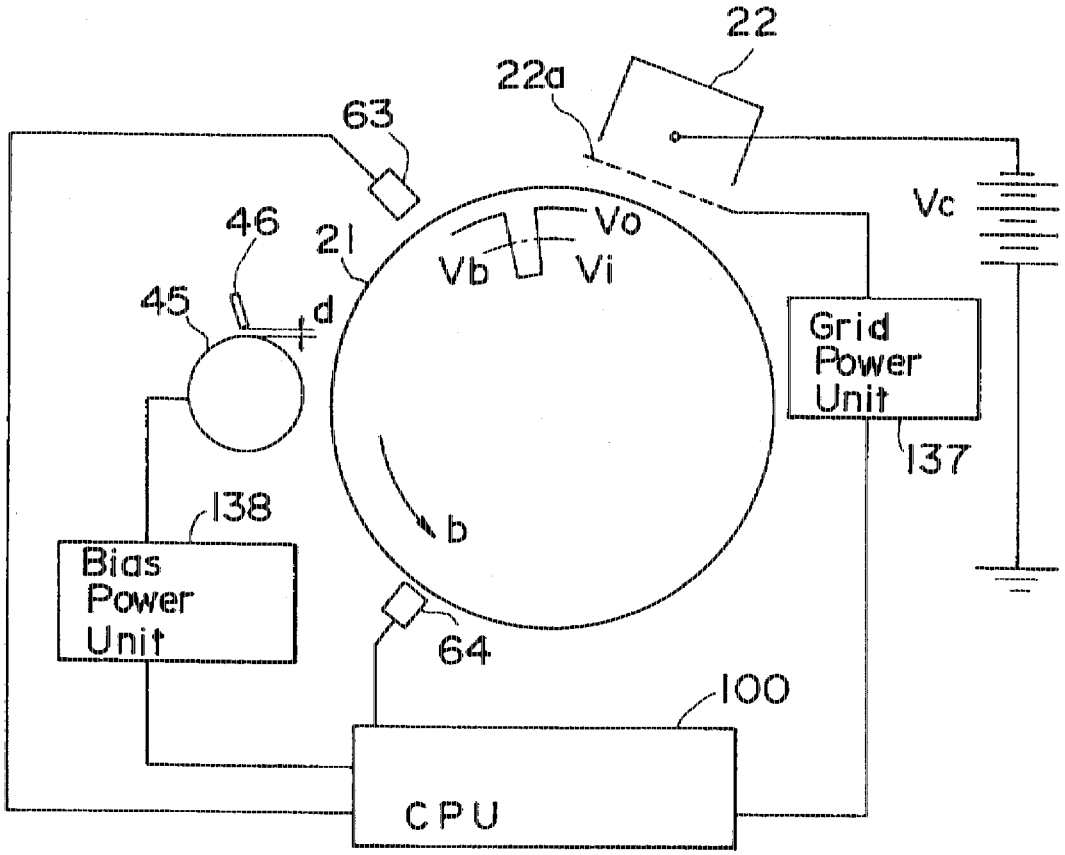
FIG. 3 is a block diagram showing the image density control circuit.

In the previously described copying apparatus, charging of photosensitive drum 21 is accomplished by applying a grid voltage Vg from power unit 137 to grid 22*a* of charger 22 having a discharge voltage Vc (see FIG. 3). The charge potential V0 of photosensitive drum 21 prior to exposure is equal to grid voltage Vg, and charge potential V0 can be controlled by changing the grid voltage Vg.

The present embodiment utilizes so-called reversal development wherein toner adheres to the image region having a low potential Vi (0 volts) which is subjected to exposure by a laser beam emitted from laser scanning unit 10. If the charge polarity of the photosensitive member is negative, the toner charge polarity is also negative, and a negative polarity developing bias voltage Vb is applied to developing sleeve 45 of the developing device from power unit 138. In reversal development, toner adheres to the regions having a potential lower than the developing bias voltage Vb. When the image potential difference is large, developing efficiency improves, whereas when the image potential difference is low, developing efficiency is reduced. Developing efficiency refers to the amount of toner adhered to the photosensitive member per unit of developing potential difference.

The image density control forms a toner test image on photosensitive drum 21 by predetermined laser beam intensity (amount of exposure) and predetermined developing bias voltage Vb and predetermined grid voltage Vg, then detects the scattered reflection light from the toner test image by means of AIDC sensor 64. The detection signal is transmitted to CPU 100, which calculates the amount of adhered toner. If the grid voltage Vg and developing bias voltage Vb are changed to achieve a maximum image density level in accordance with the calculated amount of adhered toner, a constant image density can be maintained regardless of developing conditions.

The grid voltages Vg and developing bias voltages Vb capable of producing a maximum density level are set and stored as a table in data ROM 102.

An example of an image density control table is shown in FIG. 26. The table of FIG. 26 shows the grid voltages Vg, charge potential V0 and developing bias voltages Vb for each density table No. corresponding to an amount of adhered toner detected by AIDC sensor 64.

(1-4) Toner consumption prediction

The method for predicting toner consumption is described hereinafter. This prediction is used in black toner replenishment control.

Figure 4:
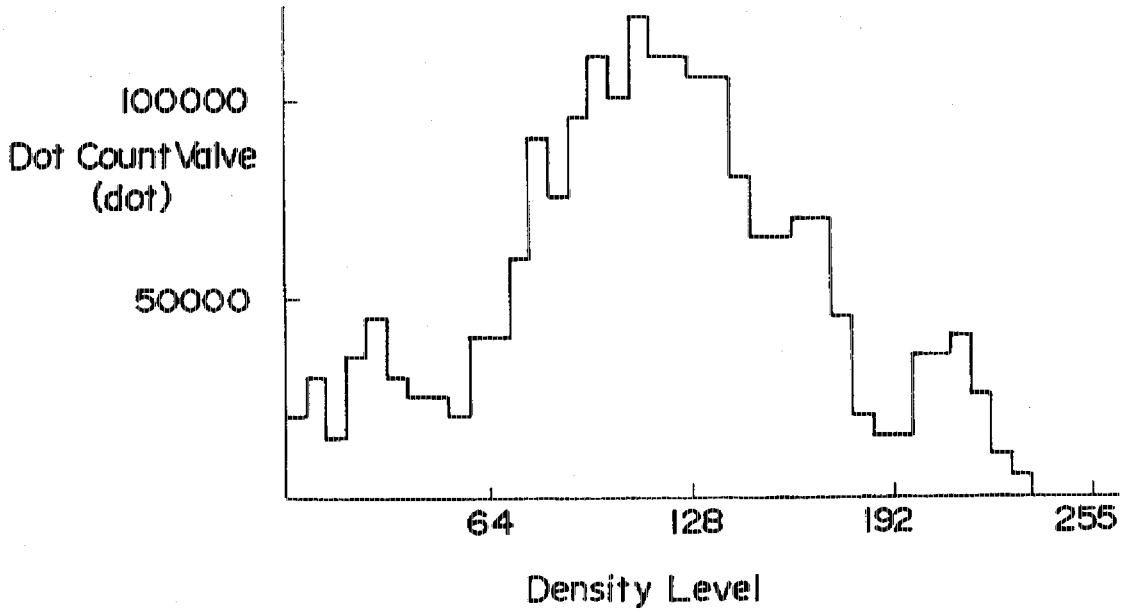
FIG. 4 is a histogram showing image density data.

In the previously mentioned counter memory 145, the number of pixels of each density level (dot count value) is recorded by generating a histogram such as shown in FIG. 4. Density levels are expressed as levels 0–255, such that the amount of toner consumed per single pixel of each density can be estimated. Accordingly, the dot count values of each density level are read out from counter memory 145, and multiplied by the amount of toner consumed per pixel to calculate toner consumption, such that toner consumption for 1 scan line can be predicted by the sum total of toner consumption for all density levels.

Figure 5:
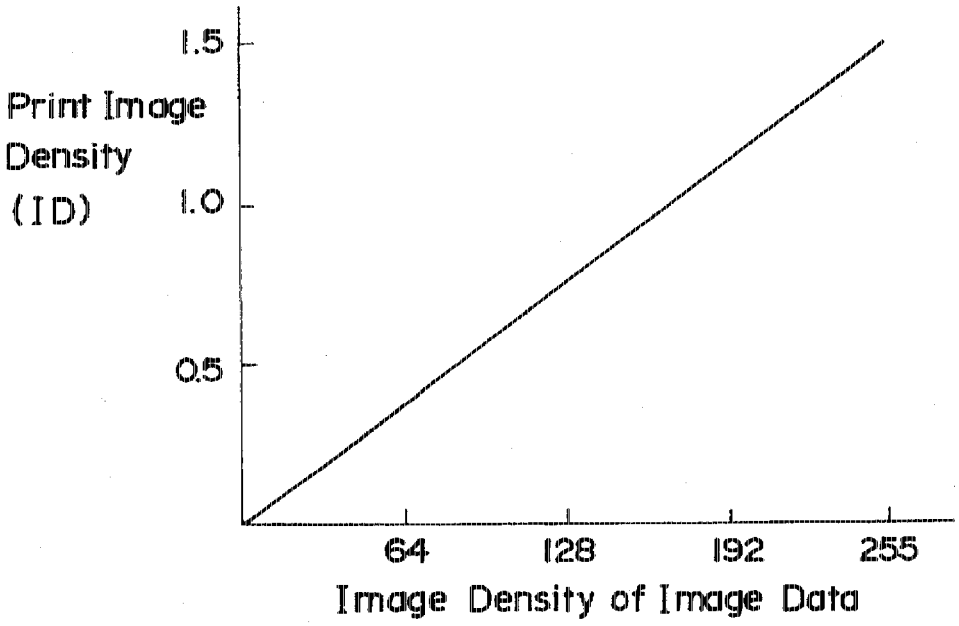
FIG. 5 is a graph showing the relationship between image density levels and image density.
Figure 6:
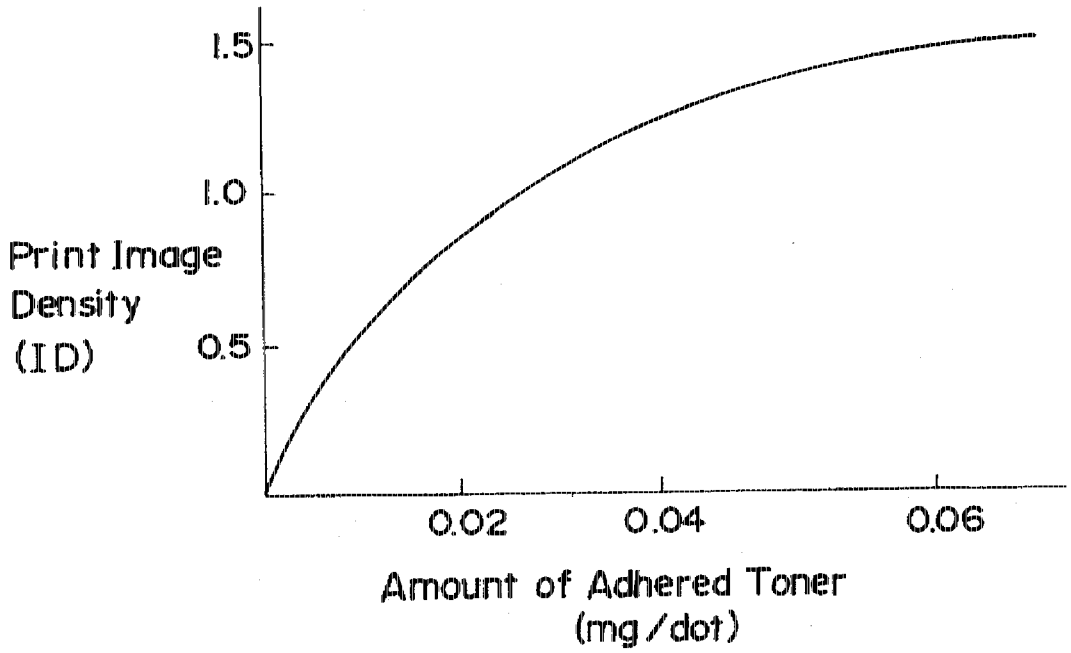
FIG. 6 is a graph showing the relationship between toner adhered on the photosensitive drum and image density.
Figure 7:
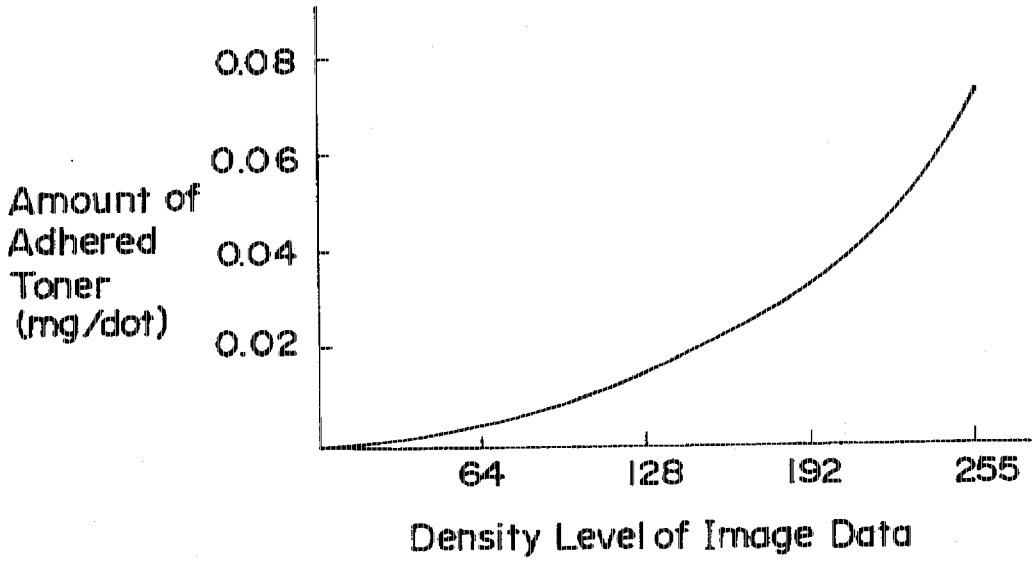
FIG. 7 is a graph showing the relationship between image density level and toner adhered to the photosensitive drum.

The amount of toner consumed per pixel is determined by the method described below, and stored in data ROM 102. That is, image halftone reproduction establishes the relationship between the density level of input print data and the density level of the image to be printed in a linear manner, as shown in FIG. 5. In the present embodiment, the relationship between the amount of toner adhered to the surface of the photosensitive member and the density of the image to be printed is shown in FIG. 6, and the relationship between the amount of toner adhered to the photosensitive member relative to the print data density is shown in FIG. 7. The relationship shown in FIG. 7 is stored in data ROM 102 in the form of a lookup table.

(1-5) Toner density estimation by AIDC

The relationship between developing efficiency and toner density by processing parameters of image formation are described below.

Figure 8:
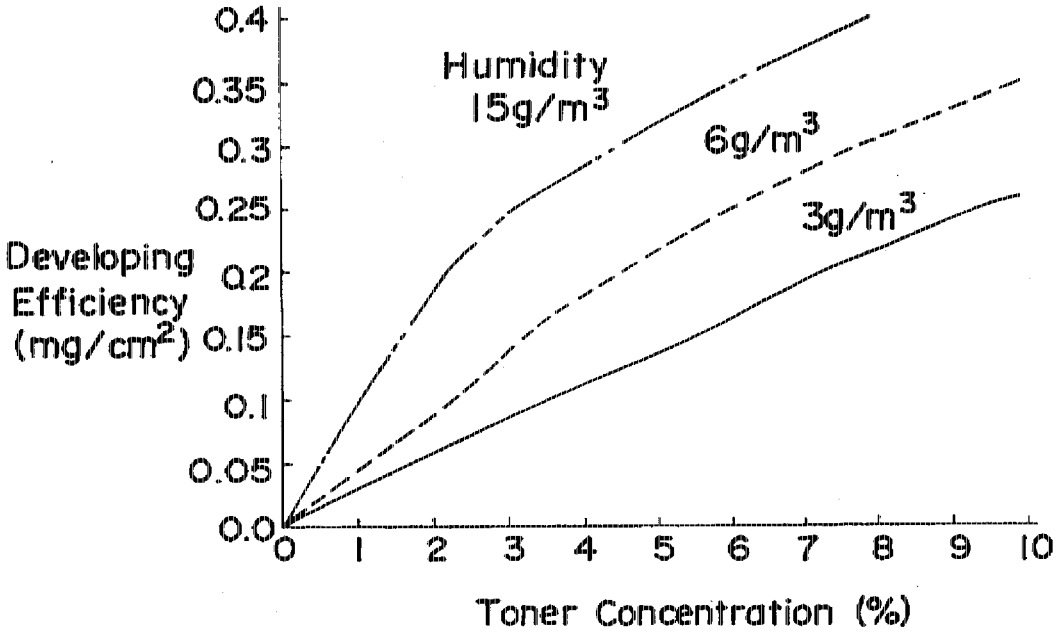
FIG. 8 is a graph showing the relationship between developing efficiency and toner density affected by humidity.
Figure 9:
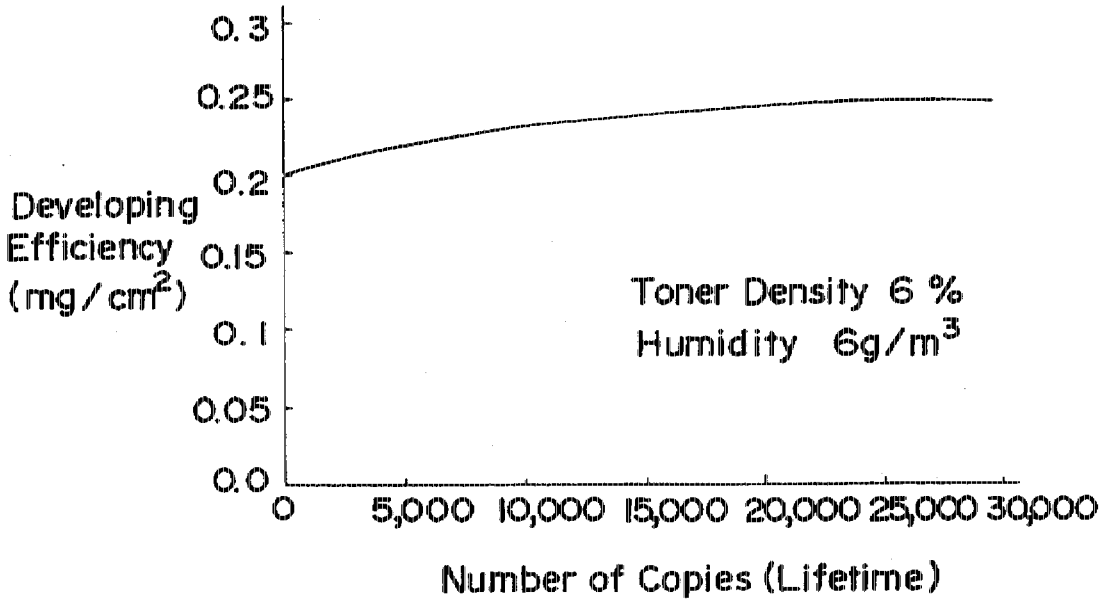
FIG. 9 is a graph showing the relationship between developing efficiency and the copy number.

In general, toner concentration in a developer can be estimated by detecting the amount of adhered toner (developing efficiency) per unit area of an image formed under constant image forming conditions. Developing efficiency is known to fluctuate, however, due to changes in various parameters, even when toner density remains constant. Consider humidity fluctuations, for example; FIG. 8 shows the relationship between toner density and developing efficiency when humidity is 3 g/m$^3$, 6 g/m$^3$, and 15 g/m$^3$. As humidity increases, the toner charge decreases and developing efficiency rises, whereas when humidity decreases, the toner charge increases and developing efficiency drops. Furthermore, developing efficiency fluctuates in conjunction with carrier fatigue accompanying the ever increasing number of copies made over the lifetime of the image forming apparatus. FIG. 9 shows an example of the initial relationship between the number of copies and developing efficiency at the start of service (i.e., toner density of 6%, humidity of 6 g/m$^3$). The copy number corresponds to carrier durability, such that as the number of copies increases, the toner charge is reduced through carrier fatigue and developing efficiency tends to rise.

Changes in temperature, type of copy mode, and time between copies (developing device idle time) and the like are also known to cause fluctuation in developing efficiency. Although toner density estimation is corrected from the lifetime copy number, humidity, temperature and detected developing efficiency in the present embodiment, other parameters may be considered.

Relative humidity and absolute humidity are discussed below. Relative humidity is the ratio of the vapor content e actually contained in a constant volume of air and the saturated vapor content E of the same air expressed as a percentage ((e/E)×100). In contrast, absolute humidity is the vapor content contained in a volume of one cubic meter of air expressed in g/m$^3$ units. Absolute humidity is determined from the temperature and the relative humidity and the saturated vapor pressure at a given temperature.

In the present embodiment, saturated vapor pressure is determined from the detection values of humidity sensor 61 and temperature sensor 62 with reference to the data tables stored in data ROM 102, and absolute humidity is obtained by the calculation method described below.

$$A=(0.01058\times H\times P)/(1+0.00366\times T)$$

where

A is Absolute humidity (g/m$^3$)

H is Relative humidity (%)

T is Temperature (°C.)

P is Saturated vapor pressure at temperature T (mmHg)

Figure 10:
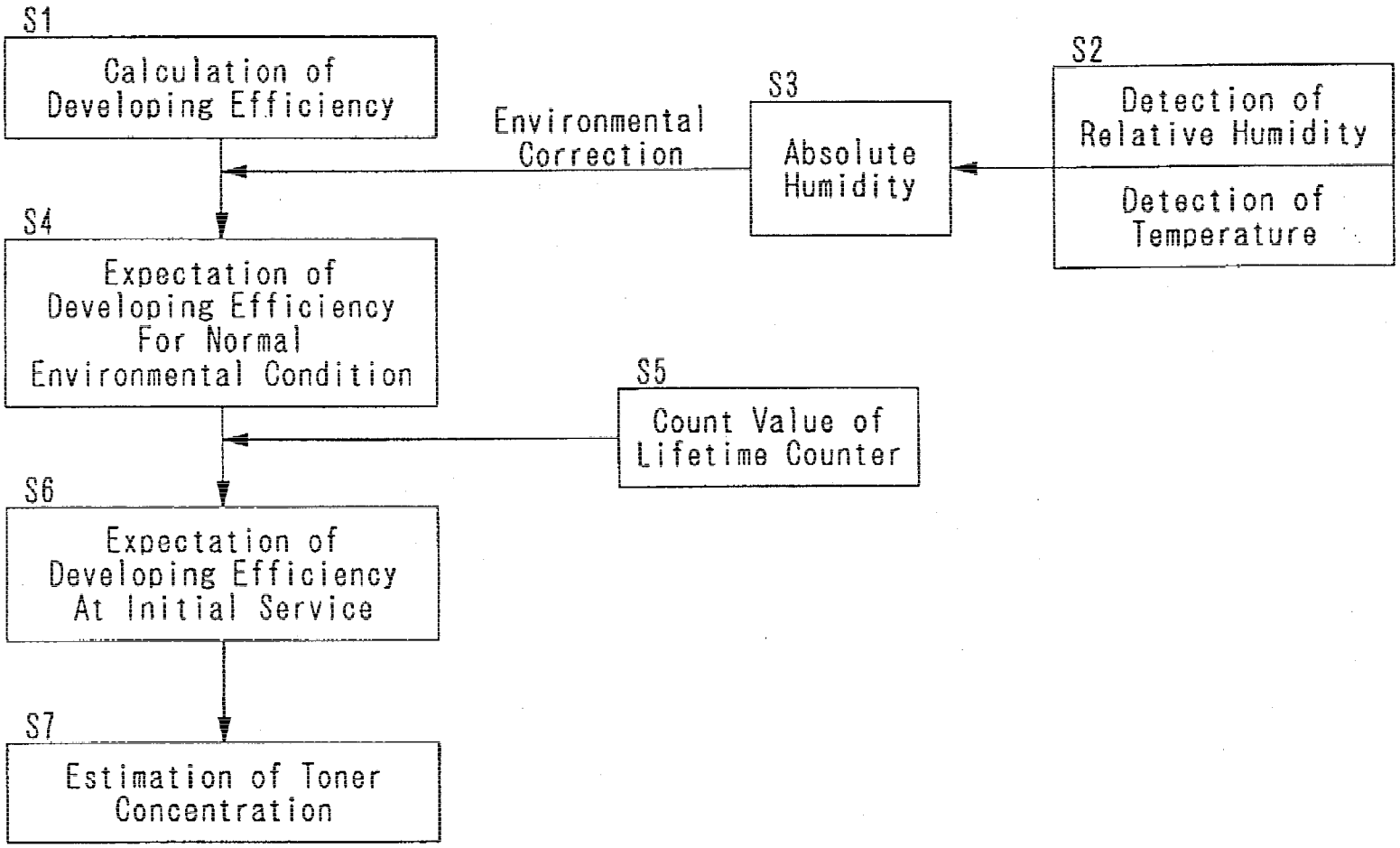
FIG. 10 is a flow chart showing the sequence for toner density estimation.

The sequence for estimating toner density is described hereinafter with reference to FIG. 10.

First, the developing efficiency is calculated (step S1). When one image forming operation is completed, a latent image test pattern is formed on the surface of photosensitive drum 21 by a predetermined grid voltage and exposure, and the potential of this latent image is measured by potential sensor 63. The latent image test pattern is developed by developing device 41Bk under a predetermined developing bias voltage so as to obtain a toner test image. The developing potential difference is the difference between the developing bias voltage and the potential measured by potential sensor 63. The amount of light reflected from the toner test image is then measured by AIDC sensor 64, and the amount of adhered toner is calculated. The determined amount of adhered toner is divided by the developing potential difference to calculate developing efficiency. The developing efficiency is defined as the amount of adhered toner per unit area per 100 V developing potential difference.

Developing efficiency thus calculated is corrected due to changes in environmental conditions and carrier durability, so as to be converted to a developing efficiency for normal environmental conditions at initial service. Environmental correction is accomplished by detecting the relative humidity by sensor 61 and detecting the temperature by sensor 62 (step S2), and calculating the absolute humidity A by the previously described calculation method (step S3). An expected developing efficiency for normal environmental conditions is determined based on the absolute humidity thus determined (step S4). The count value of lifetime counter 65 (the current lifetime number of copies) is obtained (step S5), and an expected developing efficiency at initial service is determined (step S6). These calculated data are created beforehand by actual experiments (refer to FIGS. 8 and 9), and stored in data ROM 102.

Figure 11:
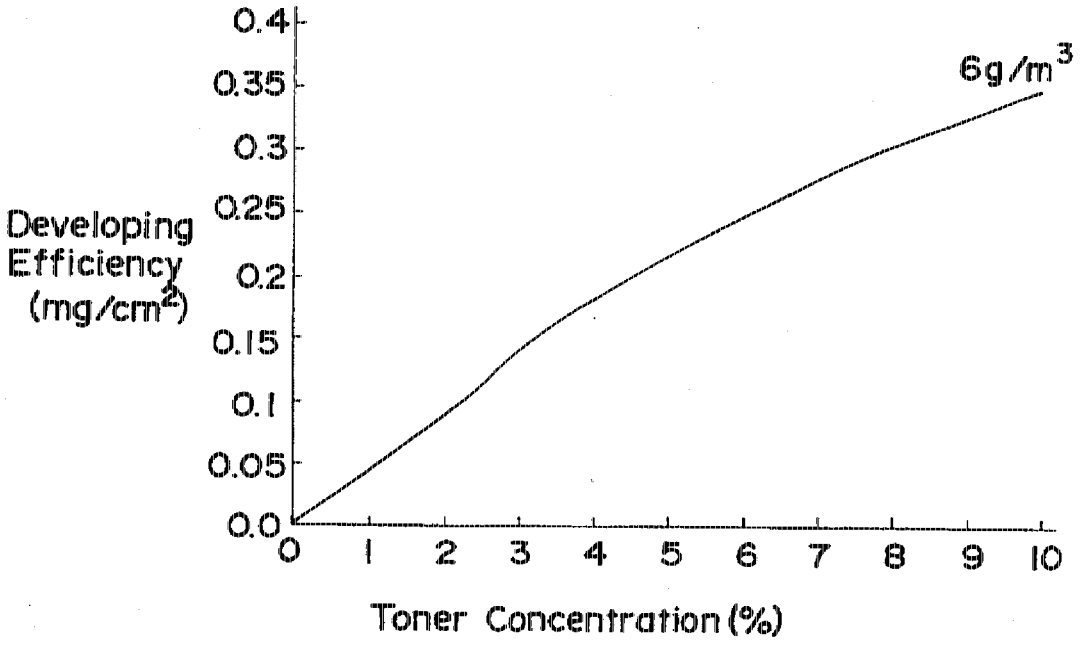
FIG. 11 is a graph showing the relationship between developing efficiency and toner concentration under normal environmental conditions and at initial service.
Figure 12:
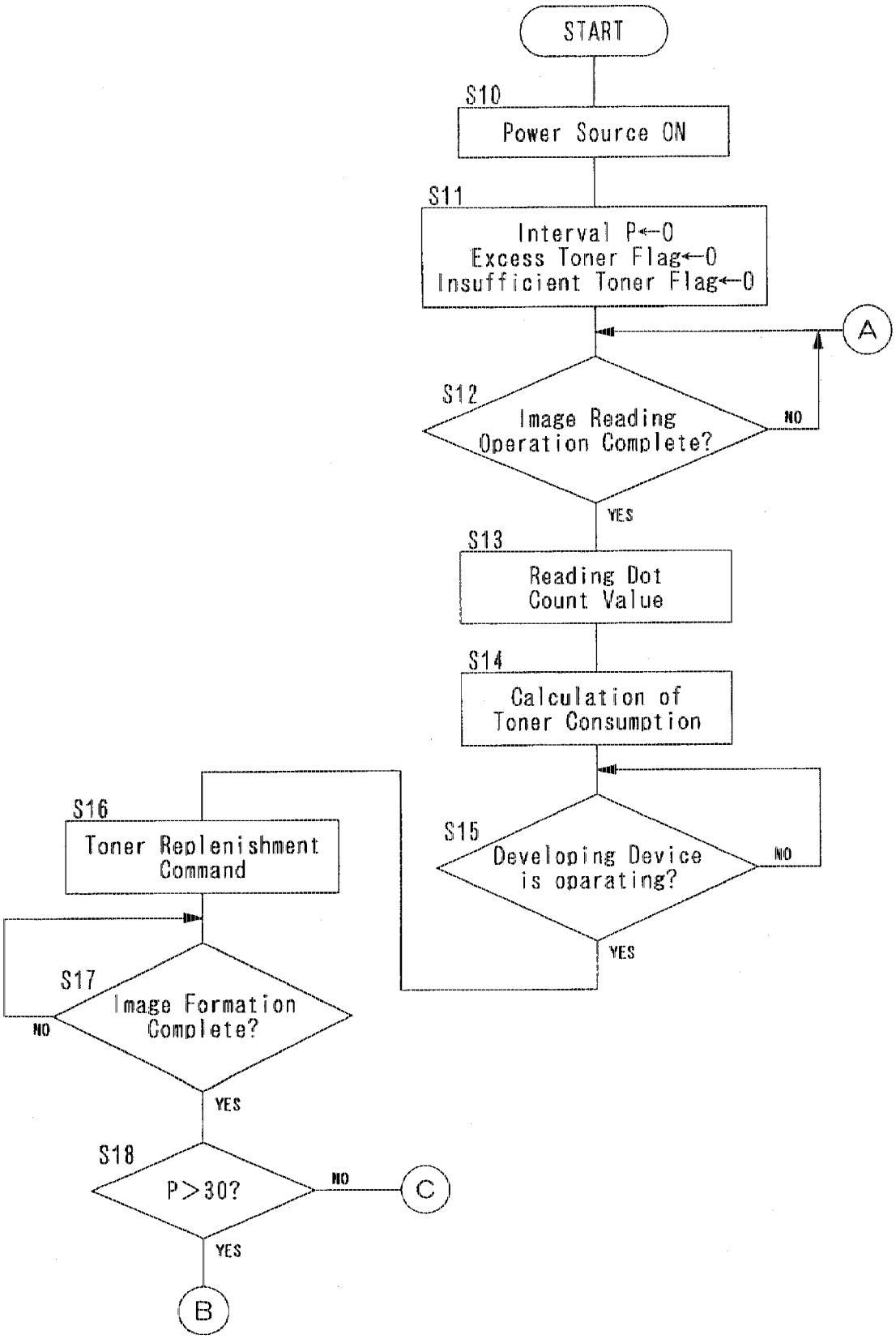
FIG. 12 is a flow chart showing the sequence of toner replenishment control of a first embodiment.

The relationship between toner density and developing efficiency under normal environmental conditions and initial service life is described in FIG. 11. This relationship is stored beforehand in data ROM 102 as a lookup table. Toner concentration is estimated from the corrected expected developing efficiency (step S7).

(1-6) Toner replenishment control

The toner replenishment control of the present invention is described below. Toner replenishment is accomplished by a method wherein toner concentration is estimated by the AIDC method after a predetermined number of image formations, or a method wherein toner concentration is estimated by AIDC after every image formation. The former method is described now in the first embodiment, and the latter method is described later in a second embodiment.

The first embodiment estimates toner concentration within developing device 41Bk by AIDC after a predetermined number of image formations (set at 30 herein), and calculates the amount of insufficient or excess toner within developing device 41Bk from the difference between the estimated toner concentration and a standard toner concentration. During subsequent image formations, the predicted toner consumption is corrected, based on the dot count value stored in counter memory 145, to eliminate insufficient toner and excess toner, thereby maintaining toner concentration at a standard value.

FIGS. 12–15 show the sequence of toner replenishment control.

First, when the power source is turned ON in step S10, the toner replenishment correction interval P is reset to [0] and the excess toner flag and insufficient toner flag are set at [0] in step S11. Then, when the print key is turned ON, a document image is read by image reader unit 1, and when completion of image reading is confirmed in step S12, the dot count value determined from the print data of 1 scan line is read out of counter memory 145 in step S13. In step S14, predicted toner consumption is calculated from the dot count value in the sequence described in a previous section "(1-4) Toner consumption prediction".

In step S15, a check is made to confirm developing device 41Bk is currently operating, and a toner replenishment command is issued in step S16. The transmitted replenishment data are data describing the replenishment amount calculated in the previous image formation. When one image formation is executed and its completion is confirmed in step S17, a check is made to determine whether or not the replenishment correction interval P is greater than [30]. In the first embodiment, AIDC is executed to correct the toner replenishment amount every 30 image formations. Thus, when 30 image formations have not occurred since the last correction, the routine advances to step S32 (FIG. 14), whereas when 30 image formations have occurred, the processes of steps S19–S31 are executed.

Figure 13:
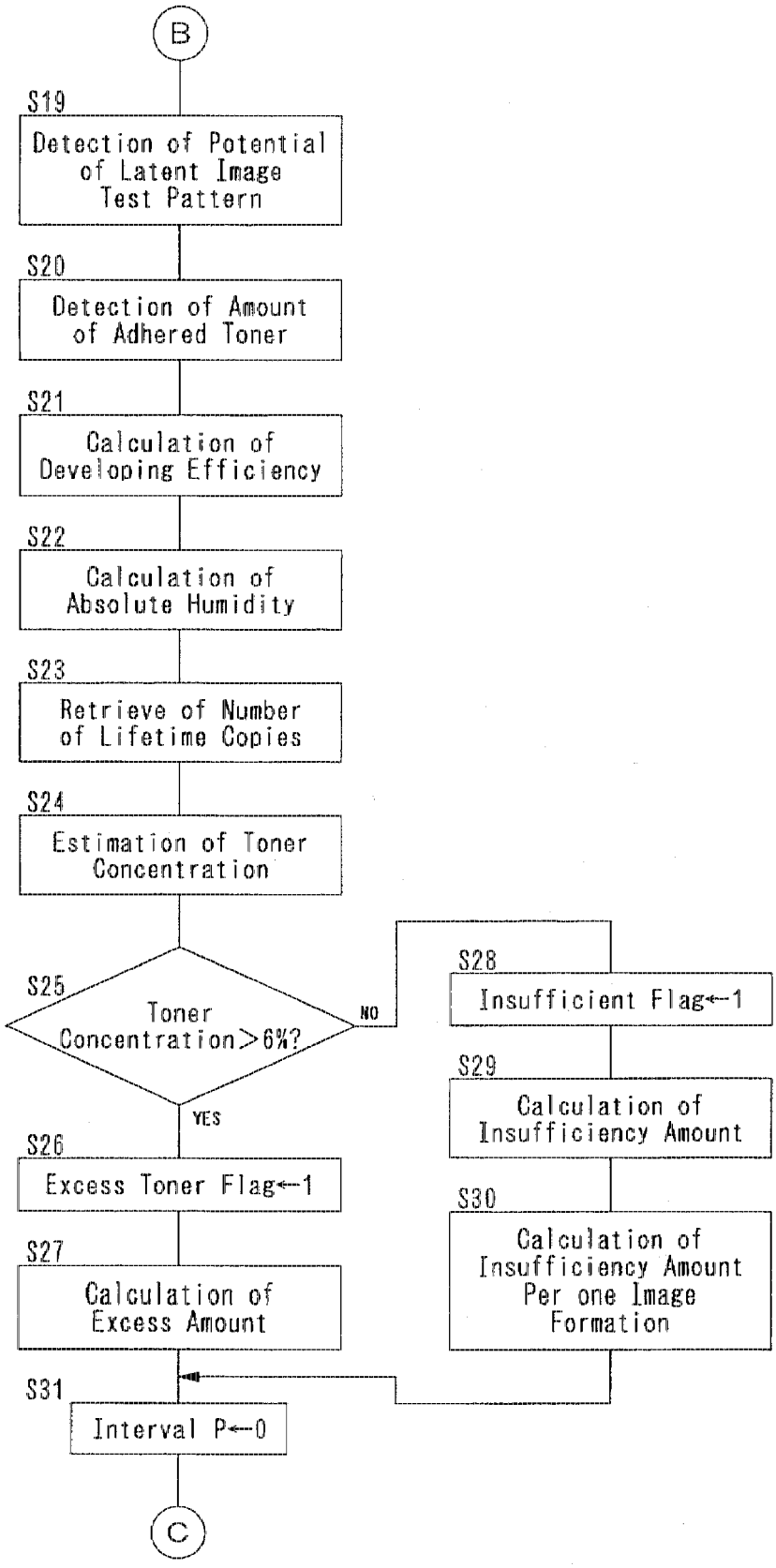
FIG. 13 is a flow chart showing the sequence of toner replenishment control of a first embodiment, continuing from FIG. 12.
Figure 14:
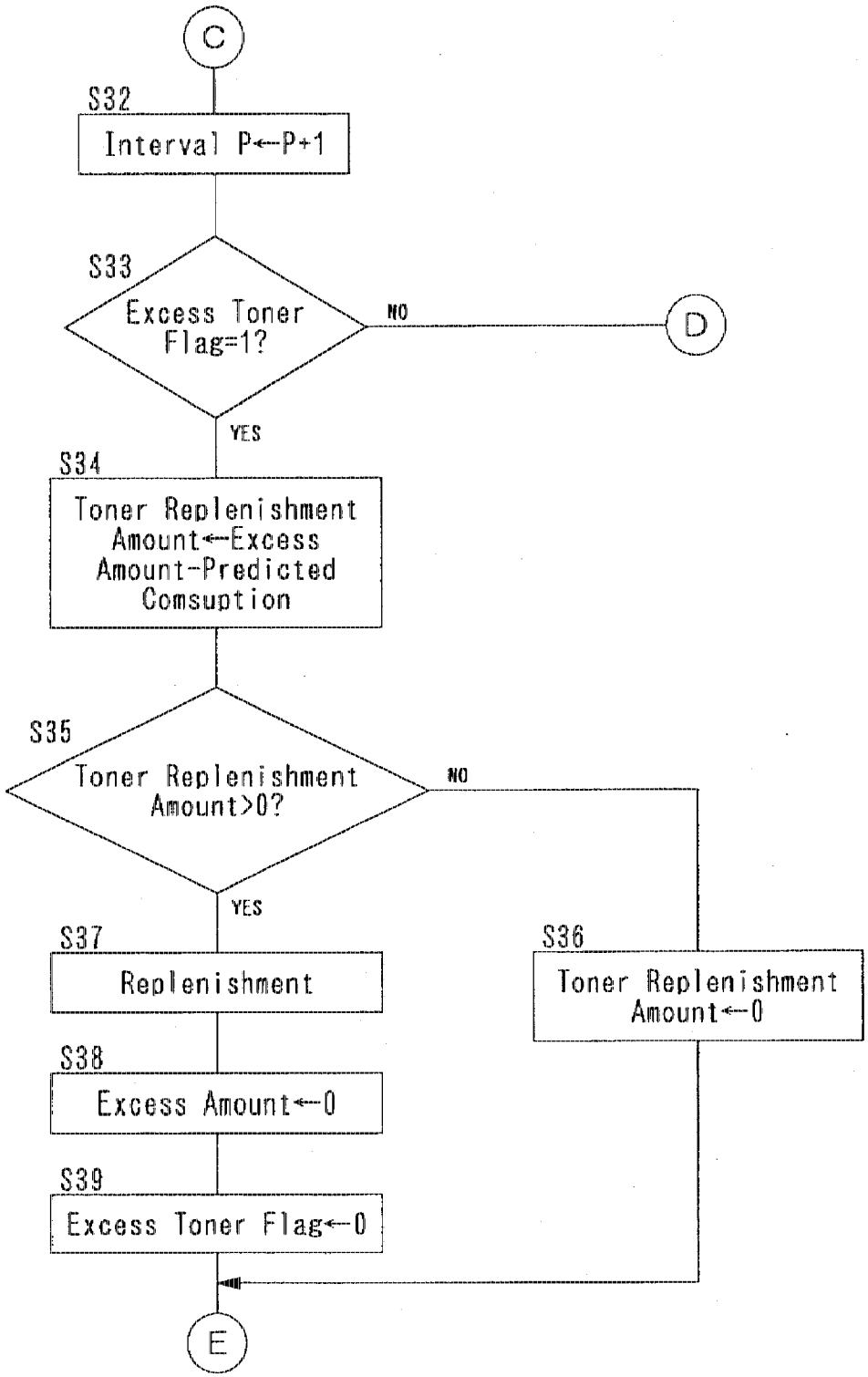
FIG. 14 is a flow chart showing the sequence of toner replenishment control of a first embodiment, continuing from FIG. 13.
Figure 15:
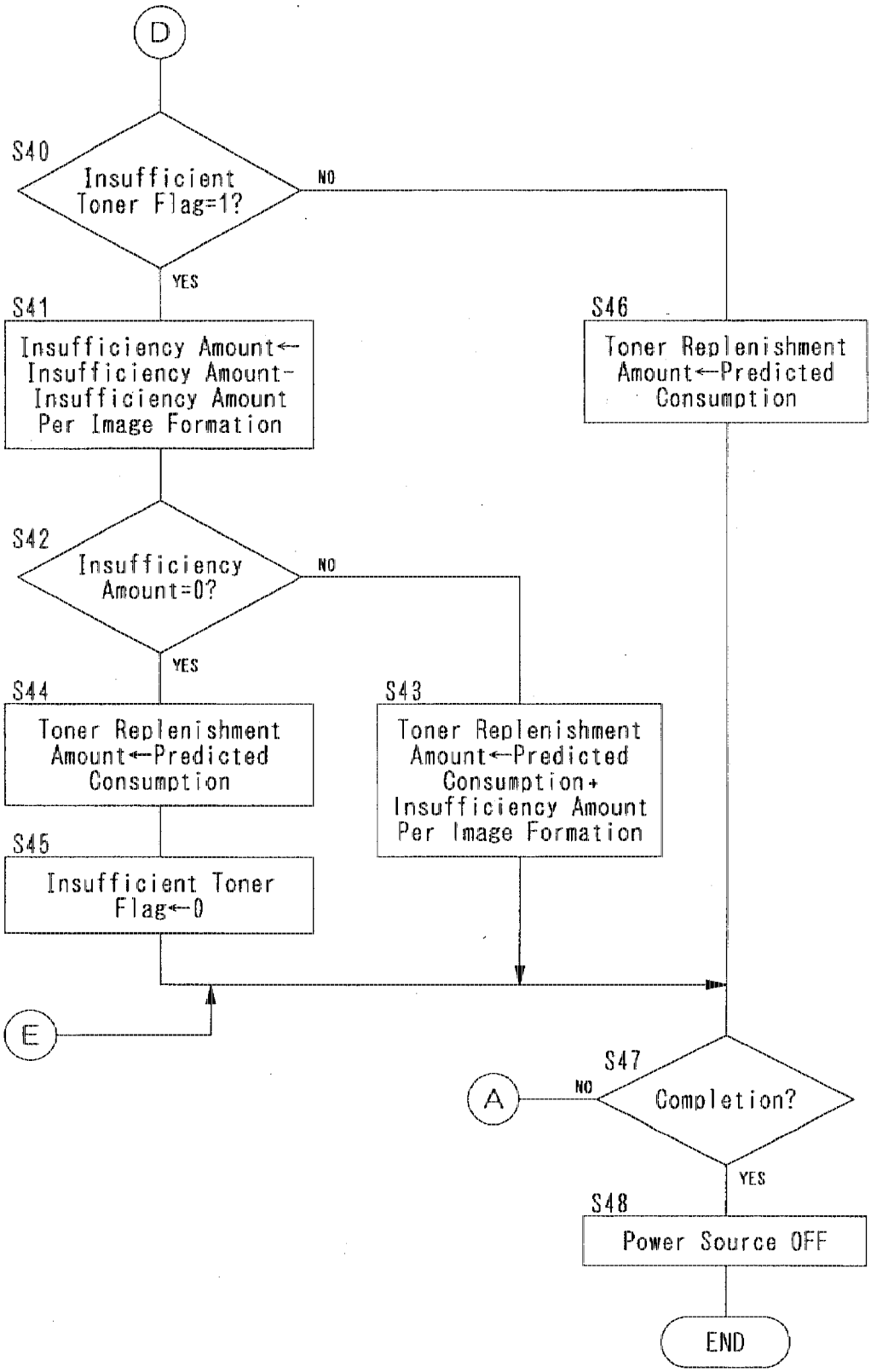
FIG. 15 is a flow chart showing the sequence of toner replenishment control of a first embodiment, continuing from FIG. 14.

The processes of steps S19–S24, shown in FIG. 13, have been described in a previous section "(1-5) Toner density estimation by AIDC". Specifically, in step S19, an electrostatic latent image test pattern is formed and its potential detected, and in step S20 the test pattern is developed and the amount of adhered toner is detected. At this time, the developing potential difference is detected from the developing bias voltage and the latent image potential. Then, in step S21, the developing efficiency is calculated by dividing the amount of adhered toner by the developing potential. In step S22 the absolute humidity is calculated, and in step S23 the count value of the lifetime counter 65 (i.e., the number of lifetime copies made) is retrieved. In step S24, the developing efficiency calculated in step S23 is corrected based on the absolute humidity calculated in step S22 and the count value previously obtained in step S21, and then the toner concentration in developing device 41Bk is estimated based on the corrected developing efficiency.

In step S25, the estimated toner concentration is compared to a standard toner concentration (6%) to determine whether there is insufficient or excess toner. If there is excess toner, the excess toner flag is set at [1] in step S26, the amount of excess is calculated in step S27, and the replenishment correction interval P is reset at [0] in step S31. If there is insufficient toner, however, the insufficient toner flag is set at [1] in step S28, and the amount of insufficiency is calculated in step S29. In step S30, the amount of insufficient toner per image formation is calculated by dividing the amount of insufficiency by 10. That is, in the first embodiment, the amount of toner insufficiency is allocated over 10 image formations to replenish the toner. In the present embodiment, the amount of carrier in the developing device is 470 grams, and the amount of toner is 30 grams at standard toner concentration (6%). If the estimated toner density is 5%, the amount of toner available in the developing device is 24.7 grams, and the amount of insufficient toner is 5.3 grams. When toner is replenished by dividing the insufficient amount by 10, the amount of toner replenished is 0.53 grams per image formation.

When toner excess or insufficiency is determined, replenishment correction interval P is incremented in step S32, a check is made to determine whether or not the excess toner flag or insufficient toner flag is set at [1] in step S33 or step S40. If the excess toner flag is set at [1], the amount of toner replenishment is calculated in step S34 by subtracting the excess amount calculated in step S27 from the predicted consumption calculated in step S14, then a check is made in step S35 to determine whether or not the replenishment amount is greater than zero. If the replenishment amount is less than zero or equal to zero, the toner replenishment amount is set at [0] in step 36, and the toner replenishment is not executed. If the toner replenishment amount is greater than zero, this amount of toner is resupplied in step S37. Thus, toner concentration is controlled so as to be maintained at a standard value, excess toner amount is set at [0] in step S38, and the excess toner flag is reset at [0] in step S39.

If the insufficient toner flag is set at [1], the amount of insufficiency per image formation calculated in step S30 is subtracted from the amount of insufficiency calculated in step S29, and a check is made to determine whether or not the amount of insufficiency is zero in step S42. If the amount if insufficiency is not zero, in step S43, the amount of insufficiency per image formation is added to the predicted consumption determined in step S14 and designated the replenishment amount, and this amount of toner is resupplied. When the amount of insufficiency is zero, i.e., when 10 image formations have been performed, the predicted consumption is designated the replenishment amount in step S44, and said amount of toner is resupplied. Then, the insufficient toner flag is reset at [0] in step S45.

On the other hand, if both the excess toner flag and insufficient toner flag are both reset at [0], the predicted consumption is designated the replenishment amount in step S46, and this amount of toner is resupplied.

Then, completion of all operations is confirmed in step S47, the routine returns to step S12 if image formation is continuing, or power is turned off in step S48 and the previously described controls are completed.

(2) Second Embodiment

The second embodiment pertains to the copying apparatus having the construction and control unit described in FIGS. 1 and 2, and estimates toner concentration within developing device 41Bk by AIDC for every image formation, inputs a predicted toner consumption determined based on the estimated toner concentration and the dot count values obtained from counter memory 145, and utilizes fuzzy inference to output a toner resupply amount so as to control toner replenishment thereby.

The sequence of toner replenishment control is described hereinafter with reference to FIG. 16.

When a power source is turned on in step S50, and it is verified in step S51 that operation of the copier has not ended, a document image is scanned by image reader unit 1 when the print key is turned ON, and when completion of said scanning is confirmed in step S52, the processes are executed identically to steps S13 and S14 of the first embodiment, i.e., in step S53 a dot count value determined from 1 scan line of print data is retrieved from counter memory 145, and in step S54 predicted toner consumption is calculated from this dot count value.

Then, in step S55, a check is made to determine that developing device 41Bk is currently operating, and in step S56 a toner replenishment command is issued. The transmitted toner replenishment data are data describing the amount of toner to be resupplied for the previous image formation. When one image formation has been performed, the toner replenishment amount is corrected by the AIDC process described below.

In step S58, an electrostatic latent image test pattern is formed and its potential is detected, then in step S59, the test pattern is developed and the amount of adhered toner is detected. At this time, the developing potential difference is detected from the developing bias voltage and the latent image potential. Then, in step S60, developing efficiency is calculated by dividing the amount of adhered toner by the developing potential difference. The absolute humidity calculated in step S61 is corrected by the count value previously obtained in step S62, and the toner concentration in developing device 41Bk is estimated based on the developing efficiency calculated in step S63. The processes of steps S58~S63 are identical to the processes of steps S19~S24 of the previously described first embodiment.

In step S64, the amount of toner replenishment is calculated from the predicted toner consumption of step S54 and the estimated toner concentration of step S63 using fuzzy inference.

(2-1) Fuzzy inference

The fuzzy inference of step S64 is described below. Fuzzy inference determines the amount of toner replenishment from the estimated toner concentration and predicted toner consumption by the rules described below.

(1) When the estimated toner concentration matches the standard toner concentration, the predicted toner consumption is designated as the amount of toner replenishment.

(2) When the estimated toner concentration is less than the standard toner concentration, an amount greater than the predicted toner consumption is designated as the amount of toner replenishment.

(3) When the estimated toner concentration is greater than the standard toner concentration, an amount less than the predicted toner consumption is designated as the amount of toner replenishment.

The conditional amounts input for the fuzzy inference process and the control amount output are described below.

Input (conditional amount):

* Predicted consumption determined by dot count value
* Estimated toner concentration determined by toner test image Output (Controlled amount):

* Amount of toner resupplied

Figure 17A:
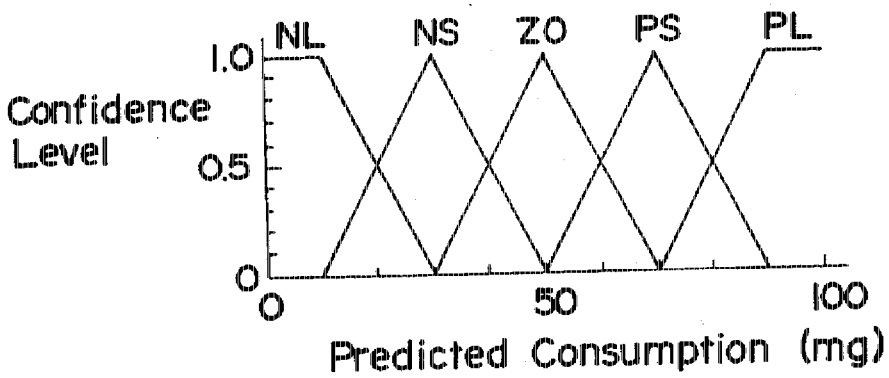
FIG. 17(*a*), FIG. 17(*b*) and FIG. 17(*c*) are charts showing the membership functions used in fuzzy inference.
Figure 17B:
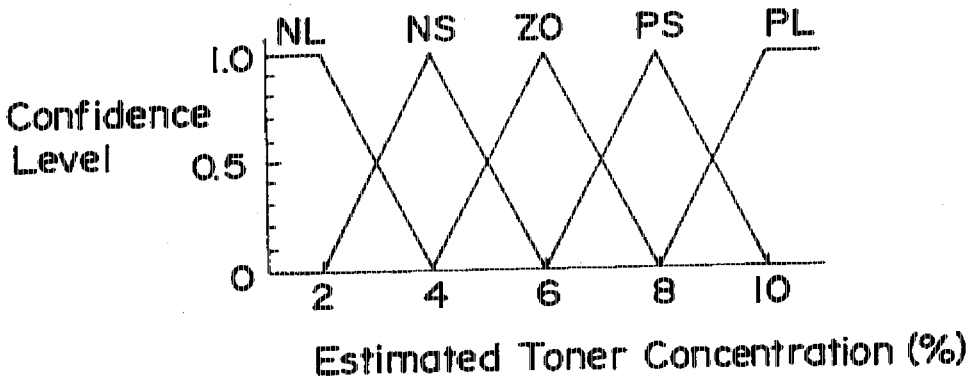
Figure 17C:
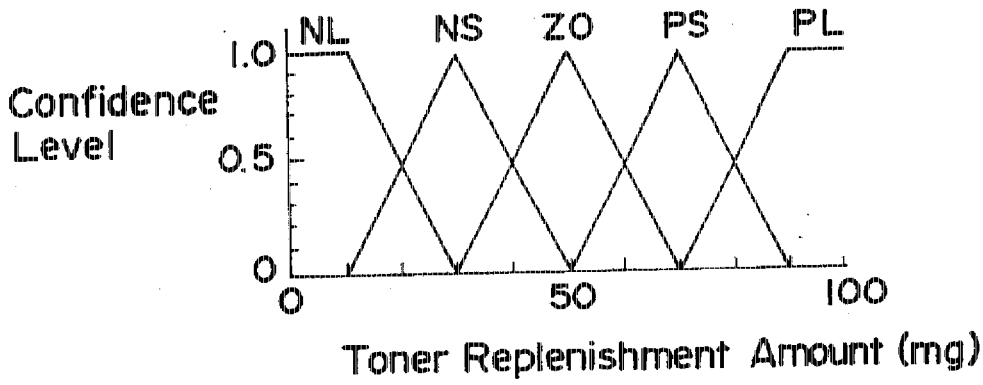

The membership functions that are used are defined as fuzzy collections of the aforesaid conditional amounts and controlled amount, as shown in FIGS. 17(*a*), 17(*b*), 17(*c*), and 17(*d*).

The symbols in the predicted consumption of FIG. 17(*a*) are defined as follows.

NL: very slight
NS: slight
ZO: standard
PS: much
PL: very much

The symbols in the estimated toner concentration of FIG. 17(*b*) are defined as follows.

NL: very low
NS: low
ZO: standard
PS: high
PL: very high

The symbols in the toner replenishment of FIG. 17(*c*) are defined as follows.

NL: very slight
NS: slight
ZO: standard
PS: much
PL: very much

Figure 18A:
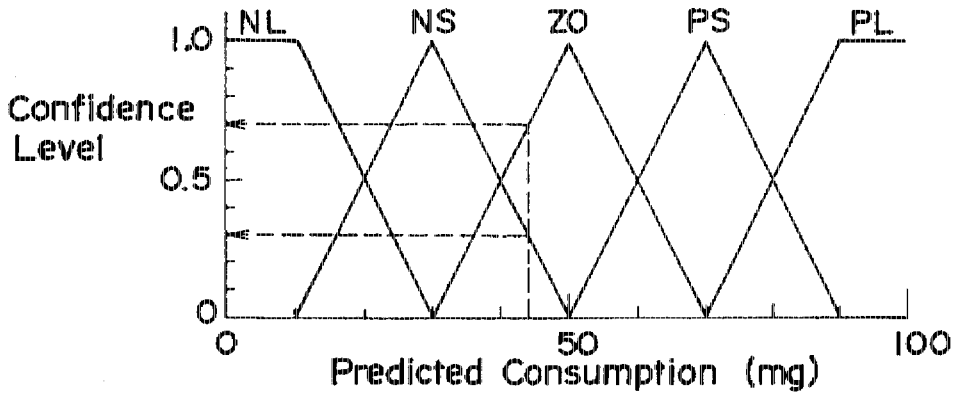
FIG. 18(*a*) and FIG. 18(*b*) are charts showing confidence levels of the membership functions.
Figure 18B:
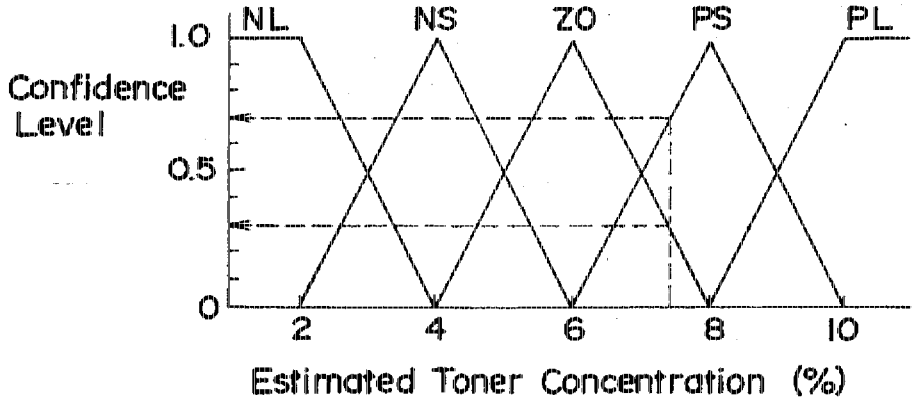

The vertical axis of the graphs represents the confidence level of the fuzzy collections of the respective symbols, with a random value range from 0–1. For example, when predicted consumption is 44 mg, NS and ZO are selected as conditional amounts as shown in FIG. 18(*a*); the confidence level of NS is 0.3, while that of ZO is 0.7. When the estimated toner concentration is 7.4%, ZO and PS are selected as conditional amounts as shown in FIG. 18(*b*); the confidence level of ZO is 0.3, while that of PS is 0.7. Thus, the confidence level of the respective conditions can be determined relative to specific input values from the aforesaid membership functions.

Control rules used in fuzzy logic are expressed in a matrix as shown in the table of FIG. 28 relative to predicted consumption and estimated concentration. There are 25 rules, which determine the controlled amounts relative to the input conditional amounts.

For example, when NS and ZO are selected as conditional amounts relative to predicted consumption, and ZO and PS are selected as conditional amounts relative to estimated concentration as previously described, the applicable control rules are shown in the table of FIG. 29.

The controlled amount is calculated from the min-max centroid method based on the membership functions for controlled amounts derived from the control rules selected in the manner described above.

Determination of the confidence level of the controlled amount of each selected rule is as follows.

Rule 1:

Confidence level of predicted consumption NS=0.3

Confidence level of estimated concentration ZO=0.3

Rule 1 asserts the confidence level of toner replenishment NS=0.3

Rule 2:

Confidence level of predicted consumption ZO=0.7

Confidence level of estimated concentration ZO=0.3

Rule 2 asserts the confidence level of toner replenishment ZO=0.3

Rule 3:

Confidence level of predicted consumption NS=0.3

Confidence level of estimated concentration PS=0.7

Rule 3 asserts the confidence level of toner replenishment NL=0.3

Rule 4:

Confidence level of predicted consumption ZO=0.7

Confidence level of estimated concentration PS=0.7

Rule 4 asserts the confidence level of toner replenishment NS=0.7

Figure 19:
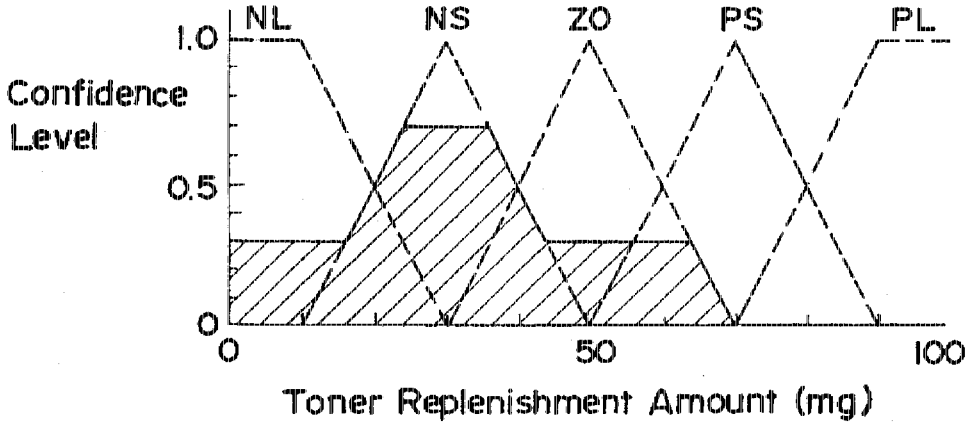
FIG. 19 is a chart showing calculations for controlled amounts in fuzzy inference.

Then, the respective conditional amounts of the toner replenishment member functions are interrupted by the assertion results of rules 1–4, and the overlapping parts are expressed by shading (refer to FIG. 19). The center of this shaded area becomes the controlled amount, which in the present example is 33 mg.

Although the controlled amount is calculated using the min-max centroid method in the present embodiment, it is to be understood that simple logic methods may be used wherein the latter portion of the inference rules are defined as constants rather than by fuzzy inference, so as to calculate the controlled amount by weight averages, or methods using different inference sequences such as function-type inference methods which define the latter portions as functions.

(3) Third Embodiment

When the developing sleeve rotates during development, toner is reduced in addition to that adhered to the surface of photosensitive drum 21 by airborne dispersion or spillage so as to leak from the developing device. Accordingly, it is necessary to consider the quantity of toner thus lost so as to obtain a target image density on the photosensitive member. The amount of toner loss can be understood experimentally through its correlative relationship with toner charge; the toner charge changes constantly in accordance with environmental conditions, particularly humidity.

Figure 20:
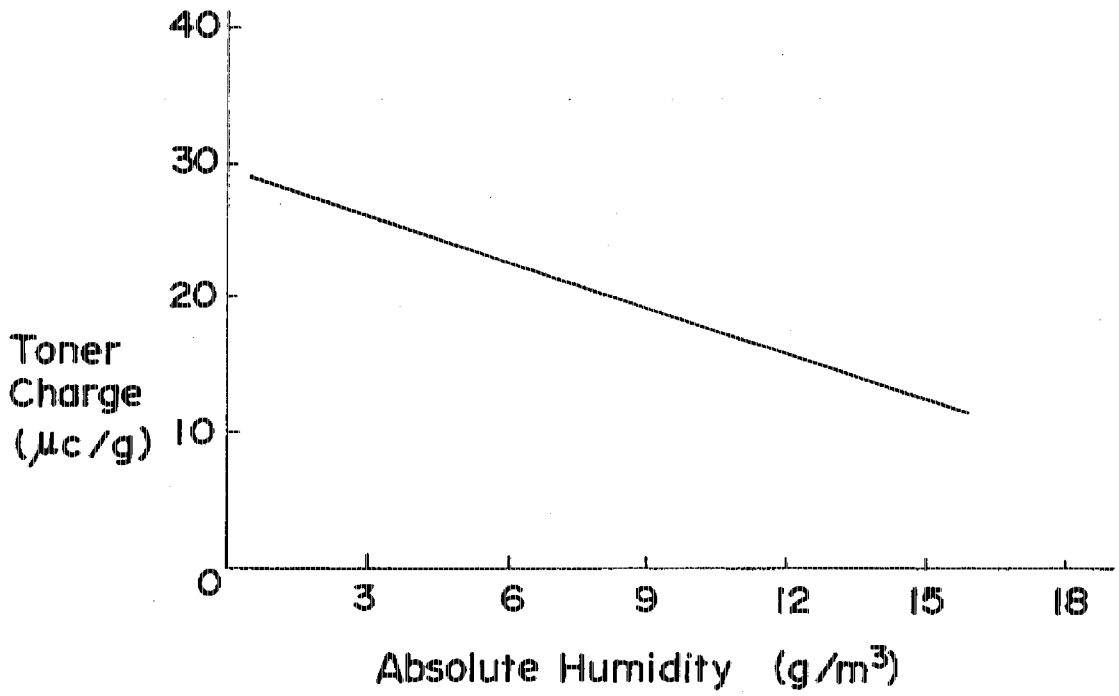
FIG. 20 is a graph showing the relationship between toner charge and absolute humidity.

FIG. 20 shows the changes in toner charge relative to absolute humidity. The amount of toner charge decreases as the absolute humidity rises. When the toner charge is reduced, toner becomes airborne, spills and leaks outside the developing device. For example, toner loss is 1.3 times the predicted consumption under environmental conditions of 6 $g/m^3$ absolute humidity as shown in FIG. 30. The table in FIG. 30 shows the correction coefficients for toner loss when changes in toner charge relative to absolute humidity are considered. This correction coefficient is stored beforehand in data ROM 102 as a lookup table, and is used to calculate toner replenishment.

Figure 21:
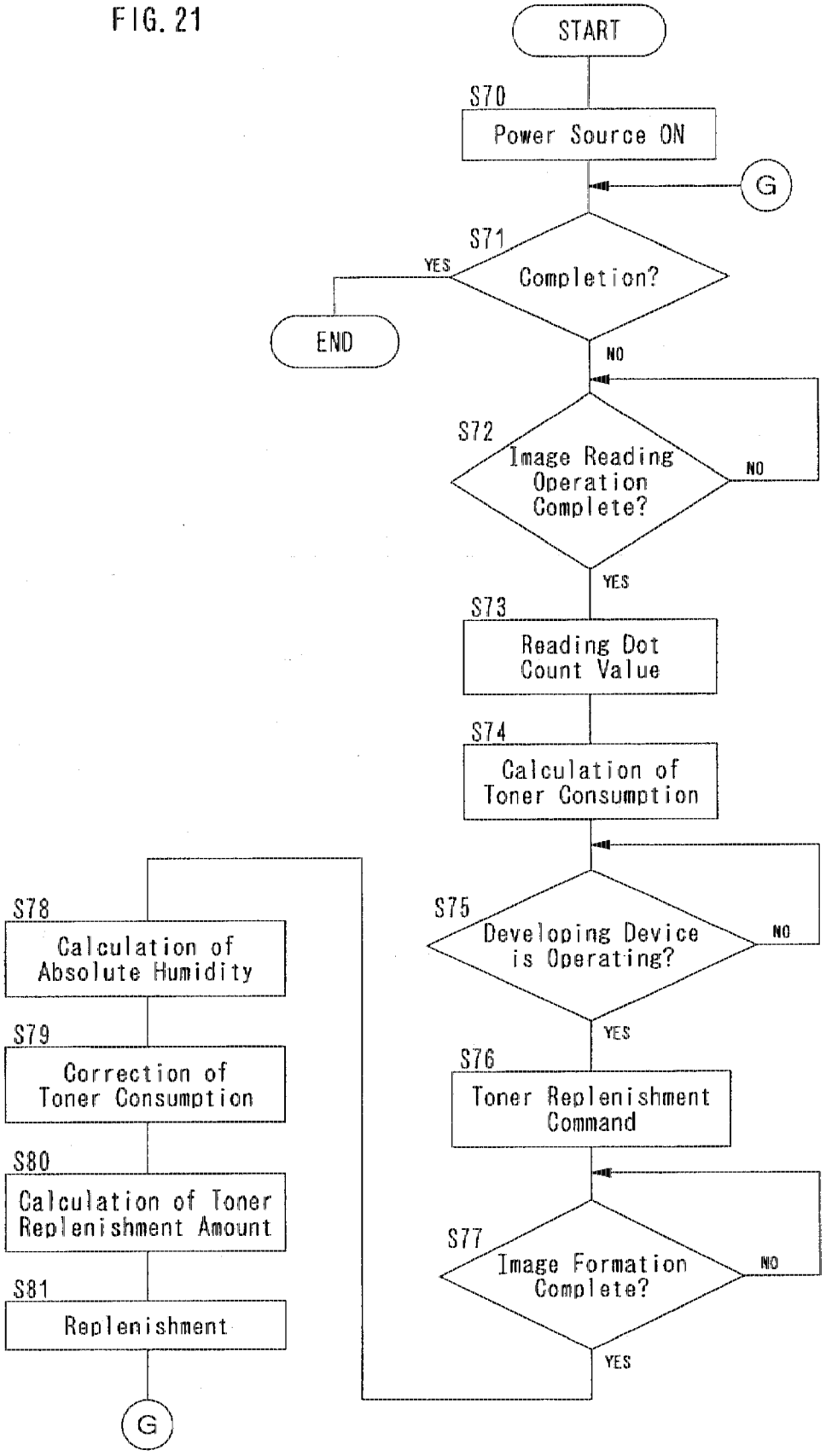
FIG. 21 is a flow chart showing the sequence for toner replenishment control of a third embodiment.

The sequence of toner replenishment control of the third embodiment is shown in FIG. 21.

First, when a power source is turned on in step S70 and it is confirmed that the operation of the copier has not ended in step S71, a document image is scanned by image reader unit 1 when a print key is pressed. When the completion of the image scanning is confirmed in step S72, the dot count value calculated from 1 scan line of print data is read out from counter memory 145 in step S73. (Steps S73 and S74 are identical to the processes of steps S13 and S14 of the previously described first embodiment.)

In step S75 the current operation of the developing device 41Bk is confirmed, and in step S76, a toner replenishment command is issued. The transmitted replenishment data are data calculated in the previous image formation. When one image formation is performed and its completion is confirmed in step S77, the absolute humidity is calculated in step S78. Based on the calculated absolute humidity, the predicted toner consumption calculated in step S74 is corrected using a correction coefficient for toner loss referring to the table of FIG. 30 in step S79.

In step S80, the toner replenishment amount is calculated from the corrected toner consumption, and in step S81, toner is resupplied to developing device 41Bk.

(4) Fourth Embodiment

In the fourth embodiment, fluctuations in toner consumption accompanying changes in predicted transfer efficiency are fed back for the calculation of toner replenishment when toner is resupplied by predicting toner consumption based on dot count value.

Figure 22:
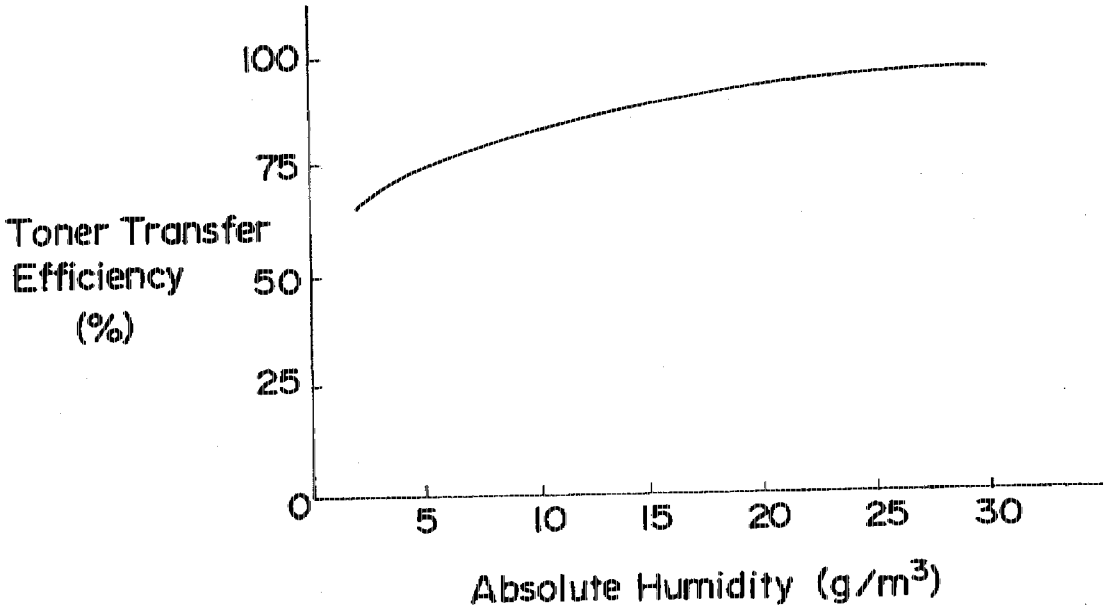
FIG. 22 is a graph showing the relationship between transfer efficiency and absolute humidity.

As shown in the table of FIG. 27, the transfer efficiency from the photosensitive member to the transfer sheet is ideally 100%, relative to the amount of toner adhered to the photosensitive member for each image density level. Transfer efficiency is subject to fluctuation due to changes in environmental conditions, particularly humidity. FIG. 22 shows changes in toner transfer efficiency relative to absolute humidity. As the absolute humidity decreases, the transfer efficiency is reduced correspondingly.

Thus, the amount of toner that adheres to the photosensitive member must be corrected beforehand in consideration of transfer efficiency, in order to achieve a target image density on the transfer sheet. Specifically, the previously mentioned developing potential difference is regulated to improve developing efficiency, so that more toner adheres to the photosensitive member in view of the reduced transfer efficiency. In this case, the toner consumption predicted by dot count value differs from the actual toner consumption. The table in FIG. 31 shows the correction coefficient for toner replenishment in view of transfer efficiency predicted from the calculated absolute humidity. This correction coefficient is stored in data ROM 102 beforehand as a lookup table, and used to calculate toner replenishment.

The sequence of toner replenishment control of the fourth embodiment is described hereinafter with reference to FIG. 23.

Figure 16:
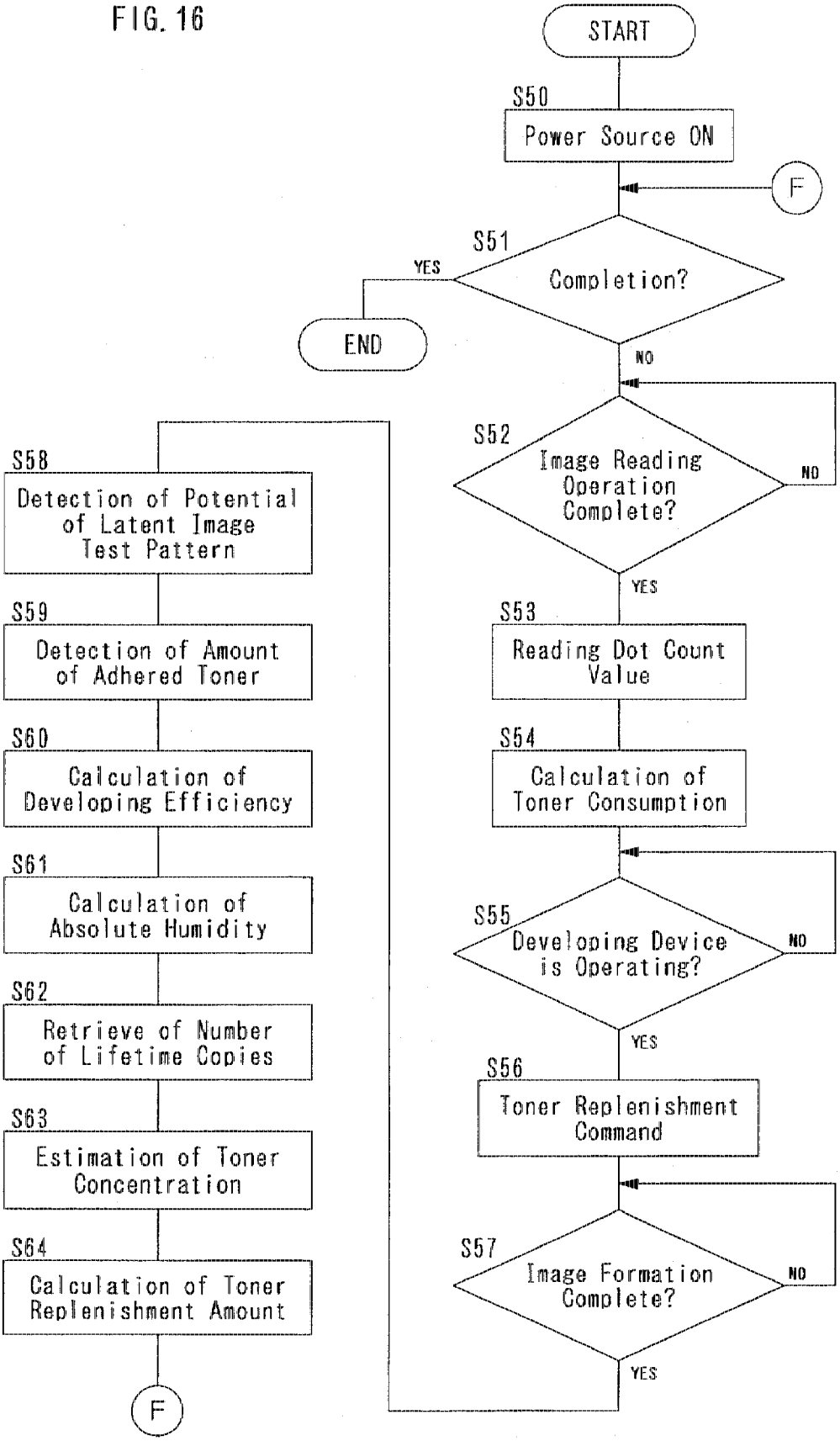
FIG. 16 is a flow chart showing the sequence of toner replenishment of a second embodiment.

Steps S100~S107 are identical to the processes of steps S50~S57 of FIG. 16 and steps S70~S77 of FIG. 21, and predict toner consumption from the dot count value. In step S108, absolute humidity is calculated, and in step S109 transfer efficiency is predicted. In step S110, the developing efficiency is corrected, based on the predicted transfer efficiency, so as to achieve a target density of the image transferred to the transfer sheet. The developing efficiency is corrected by regulating the previously described grid voltage Vg and developing bias voltage Vb using the table of FIG. 26.

Then, in step S111, the predicted toner consumption is corrected using the correction coefficient of FIG. 31, based on the predicted transfer efficiency. In step S112, the toner replenishment amount is calculated from the corrected consumption, and toner is resupplied to developing device 41Bk in step S113.

(5) Fifth Embodiment

The fifth embodiment feeds back fluctuations in toner consumption due to changes in transfer efficiency to the calculation of toner replenishment just as in the fourth embodiment. A point of departure with the fourth embodiment is that the toner transfer efficiency to transfer drum 31 (amount of adhered toner) is actually measured to detect transfer efficiency. Thus, an optical sensor 66 for optically detecting the amount of adhered toner is provided adjacent to transfer drum 31 (refer to FIG. 1), a toner test image formed on photosensitive drum 21 is transferred to transfer drum 31, and the amount of toner adhered to the transferred image is detected by sensor 66. Transfer efficiency T can be determined by the following expression:

(amt. toner on transfer drum)/(amt. toner on photosensitive drum).

The predicted toner consumption determined by the dot count value can be corrected by using the reciprocal 1/T of the determined transfer efficiency T as a correction coefficient. The table of FIG. 32 shows a correction coefficient for toner replenishment in consideration of the actual/calculated transfer efficiencies T. This correction coefficient is stored beforehand in data ROM 102 as a lookup table, and used to calculate toner replenishment.

Figure 24:
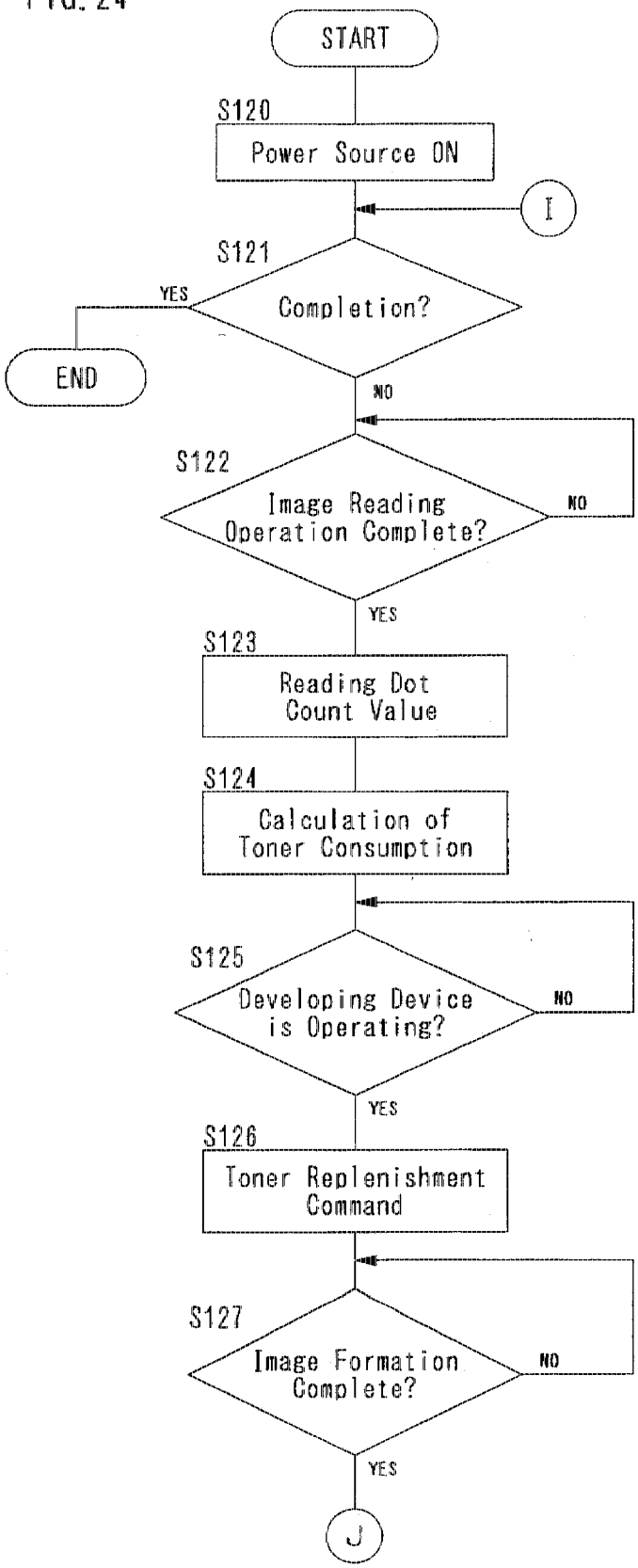
FIG. 24 is a flow chart showing the sequence for toner replenishment control of a fifth embodiment.
Figure 25:
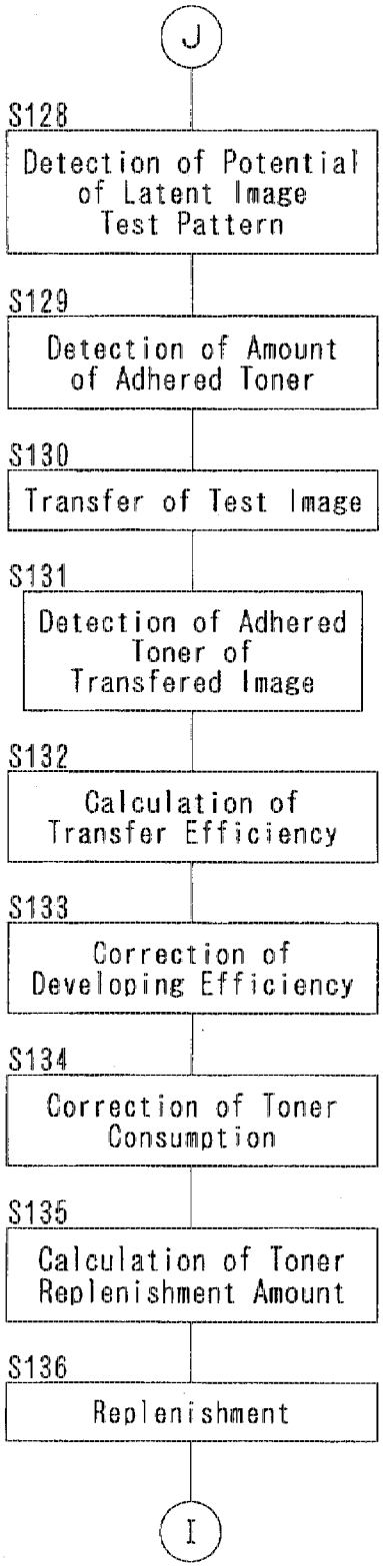
FIG. 25 is a flow chart showing the sequence for toner replenishment control of a fifth embodiment continuing FIG. 24.

The sequence of toner replenishment control of the fifth embodiment is described hereinafter with reference to FIGS. 24 and 25.

Figure 23:
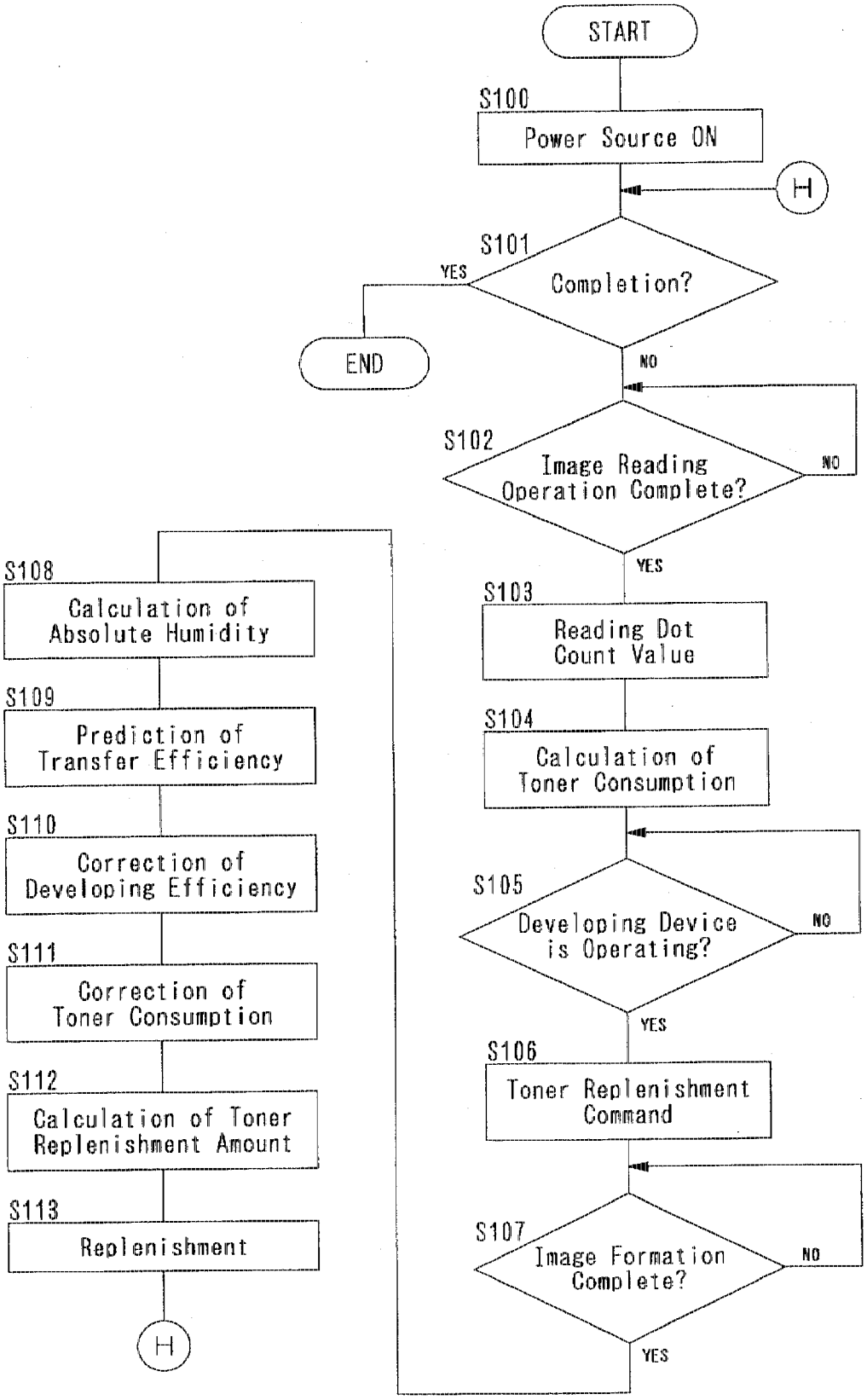
FIG. 23 is a flow chart showing the sequence of toner replenishment control of a fourth embodiment.

Steps S120~S127 are identical to the processes of steps S100~S107 of FIG. 23 for predicting toner consumption from dot count values. In step S128, a latent image test pattern is formed and its potential detected, then, in step S129, the test pattern is developed and the amount of adhered toner is detected. In step S130, the toner image is transferred to transfer drum 31, and in step S131, the amount of toner adhered to the transferred test pattern image is detected.

In step S132, the transfer efficiency T is calculated, and in step S133 the developing efficiency is corrected based on the transfer efficiency T, so as to achieve a target density for the transferred image density. The developing efficiency is corrected by regulating the previously described grid voltage Vg and developing bias voltage Vb using the table of FIG. 26.

In step S134, the predicted toner consumption is corrected using the correction coefficient (1/T) of the aforesaid table 7 based on transfer efficiency T. In step S135, the amount of toner replenishment is calculated from the corrected consumption, and in step S136 toner is resupplied to developing device 41Bk.

Other Embodiments

The image forming apparatus of the present invention is not limited to the previously described embodiments and may be variously modified insofar as those modifications do not depart from the scope of the appended claims.

The present invention, in the form of a digital type image forming apparatus, is applicable to not only full color copiers, but also monochrome copiers and laser printers.

What is claimed is:

1. An image forming apparatus comprising:

image forming means for forming a latent image on a photosensitive member in accordance with an image signal expressing a density level for each pixel;

a developing device which stores developer including toner and develops the latent image on said photosensitive member with toner;

estimating means for estimating toner concentration in a developer within the developer device, relative to a standard toner concentration, by detecting an amount of toner adhered to a developed image formed on the photosensitive member;

predicting means for predicting an amount of toner consumed in development based on the density level of each pixel expressed by image signals; and toner replenishment control means for adjusting said amount of consumed toner predicted by predicting means in accordance with said estimated relative toner concentration, and for replenishing the toner in said developer device by said adjusted amount.

2. The image forming apparatus as claimed in claim 1, wherein said estimating means includes a sensor for detecting the amount of toner adhered to the developed test image, a sensor for detecting the surface potential of the photosensitive member, a temperature sensor, a humidity sensor, and a counter for counting a number of copies made, and estimates toner concentration in a developer by calculating developing efficiency based on information from said various sensors and said counter.

3. The image forming apparatus as claimed in claim 1, wherein said estimating means executes toner concentration estimation for each single image operation, and said toner replenishment control means determines an amount of toner identical to the toner consumption predicted by said predicting means when the estimated toner concentration is equal to a standard toner concentration, and determines an amount of toner in excess of the toner consumption predicted by said predicting means when the estimated toner concentration is less than a standard toner concentration, and determines an amount of toner less than the toner consumption predicted by said predicting means when the estimated toner concentration is greater than a standard toner concentration.

4. The image forming apparatus as claimed in claim 3, wherein said toner replenishment control means describes the predicted toner consumption, estimated toner concentration, and amount of toner replenishment by membership functions, and determines the amount of replenishment toner by fuzzy inference.

5. The image forming apparatus of claim 1, wherein said estimating means estimates said relative toner concentration for each image formed on said photosensitive member.

6. An image forming apparatus comprising:

image forming means for forming a latent image on a photosensitive member in accordance with an image signal expressing a density level for each pixel;

a developing device which stores developer including toner and develops the latent image on said photosensitive member with toner;

predicting means for predicting the amount of toner consumed in development based on the density level of each pixel expressed by image signals;

detecting means for detecting an environmental condition within the image forming apparatus; and toner replenishment control means for correcting the toner consumption predicted by said predicting means based on the environmental condition detected by said detecting means to obtain an amount of toner replenishment which maintains constant toner concentration in said developing device.

7. The image forming apparatus as claimed in claim 6 wherein said toner replenishment control corrects the toner consumption by correction coefficients determined from the correlations between the environmental conditions detected by said detecting means and the amount of toner loss induced by said environmental conditions.

8. The image forming apparatus as claimed in claim 6 wherein said detecting means includes a humidity sensor and a temperature sensor.

9. An image forming apparatus comprising:

image forming means for forming a latent image on a photosensitive member in accordance with image signal expressing a density level for each pixel;

a developing device which stores developer including toner and develops the latent image on said photosensitive member with toner;

predicting means for predicting the amount of toner consumed in development based on the density level of each pixel expressed by image signals;

detecting means for detecting the effectiveness of toner image transfer from the photosensitive member to a sheet;

toner replenishment control means for correcting the toner consumption predicted by said predicting means based on the effectiveness detected by said detecting means, so as to determine the amount of toner to be replenished.

10. An image forming apparatus comprising:

image forming means for forming a latent image on a photosensitive member in accordance with an image signal expressing a density level for each pixel;

a developing device which stores developer including toner and develops the latent image on said photosensitive member with toner;

estimating means for estimating toner concentration in a developer within the developer device after a predetermined number of images have been formed on said photosensitive member;

determining means for determining a difference between said estimated toner concentration and a standard toner concentration;

predicting means for predicting an amount of toner consumed in development based on the density level of each pixel expressed by image signals; and toner replenishment control means for distributing said determined difference over a plurality of image forming operations and adjusting said amount of consumed toner predicted by predicting means by said distributed difference for each of said plurality of image forming operations.

11. The image forming apparatus of claim 10 wherein said plurality of image forming operations is less than said predetermined number.

* * * * *